United States Patent [19]

Haslop et al.

[11] Patent Number: 4,793,943

[45] **Date of Patent: * Dec. 27, 1988**

[54] LIQUID DETERGENT COMPOSITIONS

[75] Inventors: William P. Haslop, Cleator Moor; John M. Allonby; Brian J. Akred, both of Whitehaven; Edward T. Messenger, Workington, all of England

[73] Assignee: Albright & Wilson Limited, West Midlands, England

[ * ] Notice: The portion of the term of this patent subsequent to Oct. 21, 2003 has been disclaimed.

[21] Appl. No.: 890,530

[22] Filed: Jul. 30, 1986

Related U.S. Application Data

[60] Division of Ser. No. 684,802, Dec. 24, 1984, Pat. No. 4,618,446, which is a continuation-in-part of Ser. No. 576,632, Feb. 3, 1984, abandoned.

[30] Foreign Application Priority Data

Dec. 22, 1983 [GB] United Kingdom ..... 8334250
Jun. 20, 1984 [GB] United Kingdom ..... 8415783
Aug. 8, 1984 [GB] United Kingdom ..... 8421783

[51] Int. Cl.[4] ..... C11D 3/14; C11D 3/065; C11D 3/08; C11D 1/18

[52] U.S. Cl. ..... 252/135; 252/139; 252/155; 252/173; 252/174.14; 252/174.19; 252/174.25; 252/527; 252/539; 252/540; 252/546; 252/558; 252/DIG. 14

[58] Field of Search ..... 252/135, 174.25, 539, 252/540, DIG. 14, 173, 155, 139, 174.14, 174.19, 546, 527, 558

[56] References Cited

U.S. PATENT DOCUMENTS 4,618,446 10/1986 Haslop et al. ..... 235/135

FOREIGN PATENT DOCUMENTS 2031455 4/1980 United Kingdom .

*Primary Examiner*—Mukund J. Shah
*Attorney, Agent, or Firm*—Hopgood, Calimafde, Kalil, Blaustein & Judlowe

[57] ABSTRACT

Liquid detergent compositions suitable for laundry use consist essentially of water, Electrolyte, Active Ingredient and preferably a Builder. They comprise a space-filling, floc-like aggregate of surfactant containing spherulites, substantially cocontinuous with an aqueous liquid micellar solution. They are shear thinning, mobile, stable to shear stress, storage under extreme climatic conditions and high pH.

30 Claims, 8 Drawing Sheets

"A"
"B"
"C"
48
40
32
24
16
8
0
5
10
15
20
25

"A"
"B"
"C"
"D"
48
40
32
24
16
8
0
0
5
10
15
20
25

14
12
10
8
6
4
2
0
0
0.02
0.04
0.06
0.08
0.10

14
12
10
8
6
4
2
0
"B"
"C"
0
2
4
6
8
10
12
14
16

"B"
"C"
28
24
20
16
12
8
4
0
0
2
4
6
8
10
12
14
16

40
32
24
16
8
0
0
2
4
6
8
10
12
14
16
18
20
22

X 45,000

1μ

X 110,000

LIQUID DETERGENT COMPOSITIONS

This application is a divisional of application Ser. No. 684,802 filed on Dec. 21, 1984, now U.S. Pat. No. 4,618,446, which is a continuation-in-part of application Ser. No. 576,632 filed Feb. 3, 1984, now abandoned.

DEFINITIONS

The present invention relates to novel, aqueous-based, mobile, fluid detergent compositions preferably containing effective quantities of detergent builder.

Except where the contrary is stated, or the context otherwise forbids, the following terms in parenthesis, wherever used in this specification and claims, shall have the meanings hereinafter ascribed to them in this Definitions section.

The term "builder" is sometimes used loosely in the detergent art to include any non-surfactant whose presence in a detergent formulation enhances the cleaning effect of the formulation. More usually, however, the term is restricted to those typical "builders" which are primarily useful as a means of preventing or ameliorating the adverse effects on washing of calcium and magnesium ions, e.g. by chelation, sequestering, precipitation or absorption of the ions, and secondarily as a source of alkalinity and buffering. The term "Builder" is used herein in the more restricted sense, and refers to additives which ameliorate the effects of calcium to a substantial extent. It includes sodium or potassium tripolyphosphate and other phosphate and condensed phosphate salts such as sodium or potassium orthophosphates, pyrophosphates, metaphosphates or tetraphosphate, as well as phosphonates such as acetodiphosphonates, amino tris methylene phosphonates and ethylenediamine tetramethylene phosphonates. It also includes alkali metal carbonates, zeolites and such organic squestrants as salts of nitrilotriacetic acid, citric acid and ethylene diamine tetracetic acid, polymeric polycarboxylic acids such as polyacrylates and maleic anhydride based copolymers.

For the avoidance of doubt, "Builder" is used herein to include water soluble alkali metal silicates such as sodium silicate, but excludes additives such as carboxymethyl cellulose, or polyvinyl pyrrolidone whose function is primarily that of soil suspending or anti-redeposition agent.

"Electrolyte" is used herein to denote those ionic compounds which have a solubility in water at 0° C., expressed as wt% of anhydrous compounds, of at least 5, which dissociate at least partially in aqueous solution to provide ions, and which at the concentrations present tend to lower the total solubility (including micellar concentration) of surfactants in such solutions by a "salting out" effect. In includes water soluble dissociable, inorganic salts such as, for example, alkali metal or ammonium chlorides, nitrates, phosphates, carbonates, silicates, perborates and polyphosphates, and also certain water soluble organic salts which desolubilise or "salt out" surfactants. It does not include salts of cations which form water insoluble precipitates with the surfactants present or which are only sparingly soluble in the composition, such as calcium chloride or sodium sulphate.

References herein to the Electrolyte content or concentration refer to the total dissolved Electrolyte, including any dissolved Builder, if such Builder is also an Electrolyte, but excludes any suspended solid.

"Hydrotrope" denotes any water soluble compound which tends to increase the solubility of surfactants in aqueous solution. Typical Hydrotropes include urea and the alkali metal or ammonium salts of the lower alkyl benzene sulphonic acids such as sodium toluene sulphonate and sodium xylene sulphonate.

Whether a particular compound is an Electrolyte or a Hydrotrope may sometimes depend on the Active Ingredients present. Sodium chloride is normally considered a typical Electrolyte, but in relation to sultaines, it behaves as a Hydrotrope. "Electrolyte" and "Hydrotrope", as used herein, must therefore be construed in the context of the particular Active Ingredients.

As used herein "Soap" means an at least sparingly water soluble salt of a natural or synthetic aliphatic monocarboxylic acid, which salt has surfactant properties. The term includes sodium, potassium, lithium, ammonium and alkanolamine salts of $C_{8-22}$ natural and synthetic fatty acids, including stearic, palmitic, oleic, linoleic, ricinoleic, behenic and dodecanoic acids, resin acids and branched chain monocarboxylic acids.

The "Usual Minor Ingredients" includes those ingredients other than Water, Active Ingredients, Builders and Electrolytes which may be included in laundry detergent compositions, typically in proportions up to 5%, and which are compatible in the relevant Formulation with a Pourable, chemically stable non-sedimenting composition. The term includes antiredeposition agents, dispersants, antifoams, perfumes, dyes, optical brightening agents, Hydrotropes, solvents, buffers, bleaches, corrosion inhibitors, antioxidants, preservatives, scale inhibitors, humectants, enzymes and their stabilizers, bleach activators, and the like. As used herein "Functional Ingredients" means ingredients which are required to provide a beneficial effect in the wash liquor and includes ingredients which contribute to the washing effectiveness of the composition e.g. surfactants, Builders, bleaches, optical brighteners alkaline buffers, enzymes and anti-redeposition agents, and also anti-corrosives and anti-foams, but excludes water, solvents, dyes, perfume, Hydrotropes, sodium chloride, sodium sulphate, solubilisers and stabilisers whose sole function is to impart stability, fluidity or other desirable characteristics to a concentrated formulation. "Payload", means the percentage of Functional Ingredients based on the total weight of the composition. "Active Ingredients", means surface active materials.

All references herein to "Centrifuging", unless stated to the contrary, are to be construed as referring to centrifugation at 25° C. for 17 hours at 800 times normal gravitational force;

All references to "High G Centrifuging" mean centrifugation at 20,000 G at 25° C. Except where stated to the contrary, High G Centrifuging was carried out for 5 minutes.

The expression "Separable Phase" is used herein to denote components, or mixtures of components of a pourable detergent composition, which are each separable from the composition to form a distinct layer upon Centrifuging. Unless the context requires otherwise all references to the composition of Separable Phases are references to the compositions of the centrifugally separated phases and references to the structure of a composition related to the uncentrifuged composition. A single Separable Phase may comprise two or more thermodynamically distinct phases, which are not separable from each other on Centrifuging as in, for example, a stable emulsion or floc.

"Dispersed" is used herein to describe a phase which is discontinuously distributed as discrete particles or droplets in at least one other phase. "Co-continuous" describes two or more interpenetrating phases each of which extends continuously or as a continuous network through a common volume, or else is formed of discreet or Dispersed elements which interact to form a continuous matrix tending to maintain the position of each element in relation to the matrix when the system is at rest. "Interspersed" describes two or more phases which are either Co-continuous or of which one or more is Dispersed in the other or others.

References to "Solid Phases" are to substances actually present in the composition in the solid state at ambient temperature, and including any water of crystallization or hydration unless the context requires otherwise. References to solids include references to microcrystalline and cryptocrystalline solids, i.e. solids whose crystals are not directly observed by optical microscopy but whose presence can only be inferred. A "Solid Layer" is a solid, pasty or non-pourable gelatinous layer formed on Centrifuging.

"Total Water" refers to water present as liquid water in a predominantly aqueous phase, together with any other water in the composition, e.g. water of crystallisation or hydration or water dissolved or otherwise present in any predominantly non-aqueous phase. "Dry Weight" refers to residual weight after drying to constant weight at 140° C.

The term "Formulation" is used to describe the combination of ingredients which make up the Dry Weight of a composition. Thus the same Formulation may be exemplified by a number of compositions, differing in their Percentage Dry Weight.

"Stable" means that no layer containing more than 2% of the total volume separates from the bulk of the composition within 3 months at room temperature under normal gravity.

The "Shear Test" means a test in which a sample is passed through a straight 40 mm tube having an internal radius of 0.25 mm under a pressure of 500 p.s.i.g. The Shear Test was carried out in the case of all measurements described herein, by sucking a sample into a 500 ml pressure vessel through a broad aperture tube, replacing the broad aperture tube by the 0.25 mm radius tube and applying a nitrogen pressure of 500 p.s.i.g. in the pressure vessel until the latter was empty. The 0.25 mm tube was then replaced by the broad aperture tube so that the cycle could be repeated. Typically, the above method generates a shear rate of approximately 127,000 $sec^{-1}$.

"Shear Stable" means Stable after 3 passes through the Shear Test, "Shear Unstable" mean non-Stable after exposure to 3 or less passes through the Shear Test, or to a lower shear rate.

"Non-Shear Sensitive" means not undergoing loss of stability or substantial increase in Viscosity after exposure to moderate shear. Shear Sensitivity was determined using a Contraves "Rheomat 30" viscometer, cone and plate measuring system 2, at 25° C., increasing the shear linearly from 0 to 280 $sec^{-1}$ over 1 minute (the "upsweep") and immediately decreasing it linearly to 0 $sec^{-1}$ over 1 minute (the "downsweep"). A composition is adjudged Non-shear Sensitive if it is Stable after the cycle and if the Viscosity at 150 $sec^{-1}$ on the downsweep is not more than 10% greater than on the upsweep.

"Temperature Stable" means that no layer containing more than 5% of the volume separates from the bulk of the composition within 24 hours of being heated by immersing a 20 g. sample in a water bath maintained at 90° C. for 110 minutes, followed by immediate immersion in a water both maintained at 100° C. for 10 minutes.

References herein to the "pH" of detergent compositions, are to the pH as measured by a Pye Unicam 401 combined glass/calomel electrode.

"Conductivity" refers to specific conductance measured at 25° C. at a frequency of 50 KHertz. The results quoted were measured on a CDM3 "RADIOMETER" conductivity bridge using a CDC314 flow and pipette cell.

The "First Conductivity Minimum" refers to the graph of Conductivity against increasing dissolved Electrolyte concentration in a liquid detergent composition containing a fixed proportion of Active Ingredients to water, wherein the Conductivity, usually having initially risen to a maximum value, declines to a minimum value and then rises again. The term signifies the concentration of Electrolyte corresponding to this minimum value, or the lowest concentration of dissolved Electrolyte corresponding to one of a plurality of such minima.

All percentages, unless otherwise stated, are by weight, based upon the total weight of the composition.

All references herein to "Viscosity" except where otherwise stated are to the viscosity as measured on a cup and bob viscometer at 25° C. after two minutes running using a 20 mm internal diameter flat bottomed cup, 92 mm long, and a 13.7 mm diameter bob, 44 mm long, with conical ends having a 45° horizonal angle, and 4 mm diameter spindle. The tip of the bob was 23 mm from the base of the cup. This corresponds to Contraves "Rheomat 30" viscometer using measuring system C.

"Pourable", as used herein, means having a Viscosity of less than 2 Pascal seconds at a shear rate of 136 $sec^{-1}$.

"Viscosity Drop" means the difference between the Viscosity of a shear thinning composition measured at 21 $sec^{-1}$ and the Viscosity measured at 136 $sec^{-1}$.

"Yield Points" whenever referred to herein are as measured on an RML Series II Deer Rheometer at 25° C., using part No. MG7101.

"$L_1$" phase denotes a clear, fluid, optically isotropic, micellar solution of surfactant in water, which occurs at concentrations above the critical micellar concentration, and wherein the surfactant molecules are believed to aggregate to form spherical, oblate (disc) or prolate (rod) micelles.

"Bilayer" includes a layer of surfactant approximately two molecules thick, which is formed from two adjacent parallel layers, each comprising surfactant molecules which are disposed such that the hydrophobic portions of the molecules are located in the interior of the Bilayer and the hydrophilic portions are located on its outer surfaces. "Bilayer" is also used herein to include interdigited layers, which are less than two molecules thick. An interdigited layer may be regarded as a Bilayer in which the two layers have interpenetrated allowing at least some degree of overlap between the hydrophobic portions of the molecules of the two layers.

"Spherulite" means a spherical or spheroidal body having dimensions, of from 0.1 to 50 microns. Spherulites may sometimes be distorted into prolate, oblate, pear or dumbell shapes. "Vesicle" means a Spherulite containing a liquid phase bounded by a Bilayer. "Multiple Vesicle" means a Vesicle which contains one or more smaller Vesicles.

"Lamellar Phase" means a hydrated solid, or liquid crystal phase in which a plurality of Bilayers are arranged in a substantially parallel array, separated by layers of water or an aqueous solution, and having a sufficiently regular lattice spacing of from 25 to 70 A to be readily detectable by neutron diffraction when present as a substantial proportion of a composition. As used herein the expression excludes concentric Multiple Vesicles.

"G" phase refers to a liquid crystal Lamellar Phase, of the type also known in the literature as "neat" phase or "lamellar" phase. The "G" phase for any given surfactant or surfactant mixture normally exists in a narrow range of concentrations. Pure "G" phases can normally be identified by examination of a sample under a polarising microscope, between crossed polarisers. Characteristic textures are observed in accordance with the classic paper by Rosevear, JAOCS Vol. 31 P628 (1954) or in J. Colloid and Interfacial Science, Vol. 30 No. 4, P.500 (1969).

"Spherical G Phase" means Multiple Vesicles formed from substantially concentric shells of surfactant Bilayer alternating with aqueous phase with a "G" phase spacing. Typically conventional G phases may contain a minor proportion of Spherical G Phase.

"Lye" means an aqueous liquid phase containing Electrolyte, which phase separates from, or is Interspersed with, a second liquid phase containing more Active Ingredient and less Electrolyte than the Lye phase.

"Lamellar Composition" means a composition in which a major part of the surfactant is present as a Lamellar Phase, or in which a Lamellar Phase is the principal factor inhibiting sedimentation. "Spherulitic Composition" means a composition in which a major part of the surfactant is present as Spherulites, or which is principally stabilised against sedimentation by a spherulitic surfactant phase.

TECHNICAL BACKGROUND

Liquid detergents have hitherto been used mainly for light duty applications such as dish washing. The market for heavy duty detergents, e.g. laundry detergents, has been dominated by powders, due to the difficulty of getting an effective amount of surfactant and in particular of Builder into a stable liquid formulation. Such liquids should in theory be cheaper than powder detergents since they would avoid the need to dry and would in many instances replace the sulphate filler conventionally used in powder detergents with water. They also offer the possibilities of greater convenience and more rapid dissolution in wash water than powder. Attempts to provide solutions of the Functional Ingredients have been relatively unsuccessful commercially. One reason for this lack of success has been that the most commonly used and cost effective Builders e.g. sodium tripolyphosphate are insufficiently soluble in aqueous compositions. Moreover due to salting out effects, increasing the amount of dissolved Builder tends to lower the amount of surfactant that can be dissolved and vice versa. Potassium pyrophosphate Builders, together with amine salts of the Active Ingredients, which are more soluble, have been tried as alternatives to the sodium salts but have not been found cost effective.

Unbuilt liquid detergents containing high levels of surfactant have been marketed for laundry use, but are unsuitable for hard water areas and have enjoyed only limited success, mainly confined to markets where the use of effective builders is subject to legal constraints, and the competition from powders is correspondingly less severe.

A different approach is to attempt to suspend the excess Builder as a solid in a liquid micellar solution, or emulsion, of surfactant. The problem however has been to stabilise the system to maintain the Builder in suspension and prevent sedimentation. The literature has proposed numerous, relatively sophisticated formulations, including the use of expensive potassium salts in place of cheaper sodium salts and of solubilisers such as Hydrotropes, dispersants or solvents, all of which have prevented realisation of the potential cost saving. Even with such extraneous additives it was considered necesssary to use relatively low concentrations of solid Builder, giving limited washing effectiveness. This approach has been conditioned by certain assumptions: that the Active Ingredient should as far as possible be in solution; that the amount of Active Ingredient should be relatively high; that the amount of suspended solid should be minimised to avoid difficulties in stabilising the suspension against sedimentation; that special thickeners or stabilisers were essential to prevent sedimentation; and that Electrolytes which would desolubilise the surfactant be omitted or kept at very low levels.

A major feature of the art hitherto has been its empyrical nature. No acceptable general theory has been proposed to account for the stability of some compositions and the instability of others. There is thus no way of predicting which compositions will be stable, and no general procedure for designing a novel Stable liquid detergent. The art contains no generally applicable teaching, and even the specific examples of most of the prior patents on liquid detergents, provide compositions which separate within a few weeks. The relatively few exceptions have been apparently discovered by chance and no extrapolation has been possible.

Products of this type have been introduced commercially in Europe and Austrlia, but hsave suffered from certain serious drawbacks. The products have been relatively poor washing performers, either due to low Builder: Active Ingredient weight ratio, or to low alkalinity. They have also shown evidence of undesirable sensitivity to mechanical and/or thermal stress, e.g. on shearing or storing under extreme climatic temperature conditions. Thus some compositions separate on shearing, others become excessively viscous. Most separate after storage at either 0° or 40° C. However the art has not taught how to overcome the foregoing shortcomings.

In addition to the compositions which have been developed commercially, many compositions have been proposed in the literature which are not suitable for commercial exploitation in practice. Typically such compositions are unstable, or insufficiently stable to withstand normal storage without undergoing sedimentation, or else are too expensive to manufacture in relation to their washing effectiveness, to be considered for commercial development.

There has recently been proposed a set of compositions in which the Active Ingredients form a network of a Lamellar Phase, separable from the aqueous phase by Centrifuging, which provides a gel structure capable of supporting suspended particles of solid Builder. The gel structure is obtained by addition of sufficient Electrolyte to salt out the Active Ingredient, so as to form an aqueous Lye phase and a Separable Lamellar Phase, and by maintaining the solids content above a threshold for stability and below a ceiling for Pourability. The amount of Electrolyte required depends upon the hydrophilicity and melting point of the surfactant, and whether any solubilising additives such as Hydrotropes or solvents are present. The aforesaid gel compositions tend to be higher in Payload and in the ratio of Builder-/Active Ingredient, and to be more cost effective than known commercial liquid compositions. Indeed, the best of the aforesaid Lamellar gel compositions are more cost effective soil removing agents than the best laundry powders.

However, the Lamellar Compositions disclosed hitherto exhibit a mobility which is lower than is desirable for some purposes.

INTRODUCTION TO THE INVENTION

We have now discovered a novel group of compositions comprising Electrolye, Active Ingredients and water which are capable of suspending solids, such as Builders to form Stable compositions which combine improved washing performance with satisfactory mobility. We believe that our novel compositions owe their stability to a previously unreported spherulitic structure, and have discovered a general method of preparing stable, mobile compositions with superior washing performance from a wide range of different Active Ingredients.

Preferred embodiments of our invention exhibit at least some of the following advantages compared with products marketed hitherto: High Payload; high Builder to surfactant ratio; improved stability; lower cost due to use of cheaper ingredients and ease of production; high mobility; improved washing performance; high pH and/or alkalinity; good stability at high and/or low storage temperature; and satisfactory behaviour on shearing.

We have discovered that when Active Ingredients, dissolved Electrolyte and water are present in certain proportions, which depend upon the particular Active Ingredients and Electrolytes which are selected, a Stable Spherulitic Composition is obtained which is capable of suspending solid particles, such as Builder. We have discovered how to obtain such compositions and to identify them by a variety of physicl characteristics. We have further discovered how to optimise the proportions of Active Ingredients and Electrolyte to obtain compositions that are stable to shear stress and to the variations in temperature likely to be encountered in storage in a wide variety of climates and to high pH or alkalinity, and which are highly mobile. Unlike the compositions exemplified in the recent prior art relating to Lamellar Compositions, our novel compositions appear to be stabilised by surfactant present in a spherulitic, rather than a Lamellar Phase.

THE PRIOR ART

The prior art on liquid detergents is extremely voluminous. However, for the purpose of this invention the numerous references to light duty liquids and to unbuilt or built clear liquid laundry detergents in which all ingredients are present in solution may be disregarded. The Builder level is substantially less than desirable.

Recent general summaries of the current state of the art include JAOCS (April 1981) P356A—"Heavy Duty Laundry Detergents" which includes a review of the typical commercially available liquid formulations, and "Recent Changes in Laundry Detergents" by Rutkowski, published in 1981 by Marcel Dekker Inc. in the Surfactant Science Series.

Three principle avenues of approach to the problem of formulating fully built liquid detergents, have been to emulsify a surfactant in an aqueous solution of Builder, to suspend a solid Builder in an aqueous solution or emulsion of surfactant and to suspend solid builder in a gel having a Lamellar matrix of surfactant.

The first approach is exemplified by U.S. Pat. No. 3,235,505, U.S. Pat. No. 3,346,503, U.S. Pat. No. 3,351,557, U.S. Pat. No. 3,509,059, U.S. Pat. No. 3,574,122, U.S. Pat. No. 3,328,309 and Canadian Pat. No. 917031. In each of these patents an aqueous solution of a water soluble Binder is sufficiently concentrated to salt out the surfactant (usually a liquid non-ionic type) and the latter is dispersed in the aqueous medium as colloidal droplets, with the aid of various emulsifiers. In each case of the system is a clear emulsion, which generally, contains relatively low levels of Builder, and which is undesirably expensive due to the cost of using soluble Builders.

The second approach is exemplified by G.B. No. 855893, G.B. No. 948617, G.B. No. 943271, G.B. No. 1468181, G.B. No. 1506427, G.B. No. 2028365, E.P. No. 38101, Australian Pat. No. 522983, U.S. Pat. No. 4,018,720, U.S. Pat. No. 3,232,878, U.S. Pat. No. 3,075,922 and U.S. Pat. No. 2,920,045. The compositions described in these patents are either not stable or are not Temperature Stable or Shear Stable. Commercial products corresponding to examples of two of these patents have been marketed recently in Australia and Europe. In particular a composition corresponding to Austrialian Pat. No. 522983 has enjoyed a measure of commercial success, but has been Shear Sensitive.

The third approach is described in European Patent Specification No. 0086,614. The compositions described exhibit a matrix of Lamellar, solid or liquid crystal surfactant. Such compositions may have Viscosities higher than are desirable for certain uses.

A different approach is to suspend solid Builder in an anhydrous liquid non-ionic surfactant e.g. BP No. 1600981. Such systems are costly, restrictive with regard to choice of surfactant and give unsatisfactory rinsing properties. The level of Builder although high in relation to the total composition is low in relation to the Active Ingredients, and the cost effectiveness is therefore very low.

Several patents describe emulsions in which the Builder is in the dispersed phase of an emulsion rather than in suspension. U.S. Pat. No. 4,057,506 describes the preparation of clear emulsions of sodium tripolyphosphate, and U.S. Pat. No. 4,107,067 describes inverse emulsions in which an aqueous solution of Builder is dispersed in a liquid crystal surfactant system.

Reference may also be made to the numerous patents relating to hard surface cleaners, in which an abrasive is suspended usually in an aqueous solution of surfactant, e.g. G.B. No. 2031455, U.S. Pat. No. 3,281,367 U.S. Pat. No. 3,813,349, U.S. Pat. No. 3,956,158 and U.S. Pat. No. 4,302,347. However, the low levels of surfactant, absence of Builder and presence of high concentrations of abrasive, generally preclude these patents from being of any assistance in the formulating of laundry detergents.

Other publications of possible interest are: Australian Pat. No. 507431, which describes suspensions of Builder in aqueous surfactant, stabilised with sodium carboxymethyl cellulose or clay as a thickening agent. However, the levels of Functional Ingredients, and in particular of Builder, in the formulations exemplified, are not sufficient for a fully acceptable commercial product and stability is inadequate to provide a useful shelf life.

U.S. Pat. No. 3,039,971 describes a detergent paste containing the Builder in solution;

Fr Patent No. 2283951 describes suspensions of zeolite Builders in nonionic surfactant systems; the compositions, are however, stiff pastes rather than Mobile fluids.

U.S. Pat. No. 3,346,504 and U.S. Pat. No. 3,346,873 describe the solubilising of sultaines with Hydrotropes, which are referred to therein as "electrolytes".

A.C.S. Symposium series No. 194 "Silicates in Detergents" describes the effect of silicates on liquid detergents.

It will be understood that each of the foregoing patent references was selected from the very extensive prior art, and relevant aspects highlighted with the aid of hindsight, using our knowledge of the invention as a guide to such selection and highlighting. The ordinary man skilled in the art at the time of our first claimed priority, and without foreknowledge of the applicant's invention, would not necessarily have selected those patents as being particularly significant or those aspects as being of special interest or relevance.

The foregoing summary does not therefore represent the overall picture of the art possessed by the ordinary skilled man.

THE INVENTION

According to a first embodiment our invention provides a Stable, Pourable, fluid, detergent composition consisting essentially of Active Ingredients, Electrolyte and water and having solid-suspending properties, wherein the proportion of Electrolyte is sufficient to provide a Temperature Stable, Non-Shear-Sensitive, substantially non-Lamellar composition.

According to a second embodiment, our invention provides a Stable, Pourable, fluid, detergent composition having solid-suspending properties and comprising water, Active Ingredient and Electrolyte, wherein the proportion of Electrolyte is sufficient to provide a space-filling Spherulitic floc which is Temperature Stable and Non-Shear Sensitive.

According to a thid embodiment, our invention provides a Stable, Pourable, fluid detergent composition having solid suspending properties and which comprises water, Active Ingredient and sufficient Electrolyte to form a dispersed Stable phase containing at least part of the Active Ingredients, corresponding to a trough in the graph of Conductivity against Electrolyte concentration, which contains the First Conductivity Minimum, the proportion of said Electrolyte being within the range at which the composition is Temperature Stable and Non-Shear Sensitive.

Preferably in each of the foregoing embodiments the Electrolyte concentration is sufficient to provide a Shear Stable composition.

Preferably the composition according to each of the foregoing embodiments contain suspended solids, such as Builders and/or abrasives. The suspended solid may be insoluble in the aqueous fluid medium, already present in saturation quantities, or encapsulated in a material which prevents it dissolving in the medium.

According to a fourth embodiment, our invention provides a Stable, Pourable, fluid detergent composition containing water, Active Ingredients, Electrolyte and suspended solids, wherein the proportion of Electrolyte is sufficient to form a Shear Stable Spherulitic composition having a Yield Point of from 1 to 15 dynes $cm^{-2}$.

Preferably, the Yield Point of the composition is greater than 1.5, more preferably greater than 2, most preferably greater than 2.5, e.g. greater than 3, and preferably less than 10 dynes $cm^{-2}$. Preferably the Viscosity at 136 $sec^{-1}$ is less than 1.5, more preferably less than 1, e.g. from 0.2 to 0.6 Pascal Seconds.

According to a fifth embodiment, our invention provides a Stable, Pourable, fluid, detergent composition consisting essentially of water, from 5 to 25% based on the weight of the composition of Active Ingredients, Electrolyte and suspended solid Builder, the total weight proportion of Builder to Active Ingredient being from 1.4:1 to 4:1 and the portion of Electrolyte being sufficient to provide a Shear Stable, Non-Lamellar composition.

The composition may additionally contain the Usual Minor Ingredients. Preferably the Active Ingredients are present in a proportion of 10 to 20%, more preferably 10 to 14% by weight and the total weight ratio and the builder to Active Ingredient is from 1.5:1 to 3:1, e.g. 1.9:1 to 2.5:1.

According to a sixth embodiment, our invention provides a Stable, Pourable, fluid, detergent composition comprising water, from 5 to 25% based on the weight of the composition of Active Ingredients, Electrolyte and suspended solid Builder, and having a Pay Load of at least 35% by weight, wherein the proportion of Electrolyte is sufficient to provide a Shear Stable, Spherulitic composition.

According to a seventh embodiment, our invention provides a Stable, Pourable, fluid, detergent composition containing water from 5 to 25% by weight of Active Ingredients, Electrolyte and suspended solid Builder the total proportion by weight of Builder to Active Ingredients being from 1.5:1 to 4:1 and the proportion of Electrolyte being sufficient to provide a Spherulitic composition Stable to storage at 40° C. Preferably the proportion of Electrolyte is sufficient to render the composition Temperature Stable.

According to an eighth embodiment, our invention provides a Stable, Pourable, fluid, detergent composition comprising water, 5 to 20% by weight of Active Ingredients, Electrolyte and suspended solid Builder, the total weight ratio of Builder to Active Ingredient being from 1:1 to 4:1 and the proportion of Electrolyte being sufficient to provide a Temperature Stable, Non-Shear Sensitive composition, which on Centrifuging separates into an aqueous layer, containing more than 50% of the total weight of Active Ingredients, and a Solid Layer.

According to a ninth embodiment, our invention provides a Stable, Pourable detergent composition consisting essentially of water, dissolved Electrolyte and from 8 to 14% by weight of the composition of Active Ingredients, together with the suspended solid Builder, and optionally the Usual Minor Ingredients, which composition, on Centrifuging, separates into a Solid Layer and a single liquid layer having a Yield Point of greater than 1.5 dynes $cm^{-2}$.

According to a tenth embodiment, our invention provides a composition consisting substantially of water, Active Ingredients and Electrolyte and having solid-suspending properties, wherein the Active Ingredients are capable of forming a Stable composition at the First Conductivity Minimum, and the amount of Electrolyte present is sufficient to provide a composition having a Yield Point of greater than 1.5 dynes $cm^{-2}$ and a Viscosity measured at 136 $sec^{-1}$, of less than 0.28 Pascal Seconds.

According to an eleventh embodiment, our invention provides a Pourable, Stable, aqueous based detergent composition comprising essentially of water, Electrolyte, Active Ingredient and Builder and comprising a first predominantly aqueous liquid Separable Phase, containing at least part of the Electrolyte in solution and from 50 to 80% of the total weight of Active Ingredients, at least one Dispersed Solid Separable Phase comprising at least part of the Builder as solid.

Preferably the predominantly aqueous Separable Phase comprises at least 40% usually at least 50% e.g. at least 60% of the Total Water.

According to a twelfth embodiment, our invention provides a Pourable, Stable, aqueous based detergent composition having a Pay Load greater than 35% by weight and a pH greater than 9 and comprising water, a dissolved Electrolyte, at least 5% by weight of Active Ingredients and at least 16% by weight of Builder, which Electrolyte is present in a proportion sufficient to render the composition Shear Stable, but insufficient for the Active Ingredients to form a substantial proportion of a Lamellar Phase.

According to a thirteenth embodiment, our invention provides an aqueous-based, liquid detergent composition, comprising sufficient Active Ingredients to form a space-filling floc of surfactant containing Spherulites Interspersed with an aqueous phase and an amount of Electrolyte not less than that corresponding to the First Conductivity Minimum of the graph of electrical Conductivity against Electrolyte concentration, but below that which corresponds to the formation of a Lamellar phase, and sufficient to render the composition non-Shear Sensitive.

According to a fourteenth embodiment, our invention provides a Pourable, Stable detergent composition comprising water, Electrolyte, Active Ingredient and Builder, which separates on Centrifuging as defined herein into at least two layers including: a predominantly aqueous layer containing dissolved Electrolyte, at least 10% by weight of the Total Water, and from 80% to 50% by weight of the total Active Ingredient, and a Solid Layer containing at least a proportion of the Builder.

According to a fifteenth embodiment, our invention provides a Pourable, Stable, fluid, detergent composition consisting essentially of: water; a concentration of from 5% to 25% by weight of the composition of Active Ingredients which consist essentially of (i) at least one non-ethoxylated anionic surfactant and (ii) at least one cosurfactant that is capable of forming stable foams, the proportions of (i) to (ii) being such that if a soluble Electrolyte is added progressively to an aqueous mixture containing said Active Ingredients at said concentration, a First Conductivity Minimum is reached at which the mixture is turbid and Stable; suspended Solid Builder, the total weight ratio of Builder to Active Ingredients being from 1:1 to 4:1; and dissolved Electrolyte in a proportion sufficient to form a Stable composition corresponding to the Conductivity trough containing said First Conductivity Minimum, and greater than any concentration below which the composition is Shear Sensitive but below the maximum concentration at which it is Temperature Stable.

According to a further embodiment our invention provides a Stable, Spherulitic Composition comprising Active Ingredients, Electrolyte and water which does not exhibit a separate, clear, aqueous phase after High G centrifuging, at 20,000 G for 90 minutes.

In further detail, our invention provides Stable, Pourable, fluid detergent compositions comprising water, Active Ingredients and Electrolyte, all of which compositions exhibit at least some, but not necessarily all, of the following characteristics:

They comprise a Spherulitic phase Interspersed with a Lye or $L_1$ phase and preferably Co-continuous with the Lye or $L_1$ phase; they are substantially Non-Lamellar; they comprise a floc system which is preferably space-filling; they comprise a floc system which is formed from particles comprising the Active Ingredients which are preferably surfactant-containing Spherulites, typically having concentric shells of surfactant alternating with an aqueous, e.g. Lye, phase and having a repeat spacing of from 60 to 100 Å, prefered 70 to 90 Å, often 75 to 85, e.g. 80 Å; they comprise Spherulites of from 0.5 to 5 microns, preferably 0.6 to 5 microns diameter, which show a so-called "Maltese Cross" texture when viewed at suitable magnifications between crossed polarisers; they are shear thinning; they have a Viscosity Drop greater than 0.35, usually greater than 0.4, often greater than 0.45 Pascal seconds, but preferably less than 2 Pascal Seconds, e.g. 0.475 to 1.5, especially 0.48 to 1.1 Pascal seconds; they have a high Payload of Functional Ingredients, typically greater than 20% by weight, e.g. 25 to 75%, more usually at least 30% preferably at least 35% most preferably at least 40% by weight; they contain a high ratio of Builder to Active Ingredient e.g. greater than 1:1 preferably 1.2:1 to 4:1, more preferably 1.4:1 to 4:1, most preferably 1.5:1 to 3.5:1; they contain more than 5 and preferably more than 8% by weight of composition of Active Ingredients; they contain less than 25%, preferably less than 20%, usually less than 15%, more preferably less than 14.5%, most preferably less than 14%, e.g. from 10 to 13.5% by weight of composition of Active Ingredients; they form a single aqueous layer and a Solid Layer on Centrifuging wherein the aqueous layer usually has a Yield Point of at least 1, preferably at least 1.5 dynes $cm^{-2}$, e.g. 2 to 10 dynes $cm^{-2}$ and typically a Viscosity of less than 1.5 Pascal Seconds at 136 $sec^{-1}$; the proportion by weight of Active Ingredient in the predominantly aqueous layer formed after Centrifuging based on total Active Ingredient in the composition is greater than 50%, preferably greater than 55% e.g. greater than 60%, but is less than 90%, preferably less than 85% e.g. less than 80%, such as 75 to 65%; No clear Lye layer is observed on High G Centrifuging for 90 minutes; The pH of the composition is greater than 8.5, preferably 9 to 13, e.g. 9.5 to 12; The composition produces a wash liquor on dilution with water to 0.5% Dry Weight having a pH greater than 9.7, preferably greater than 10, e.g. 10.9 to 11.1; the alkalinity is sufficient to require at least 0.8 ml of N/10 HCl to reduce the pH of 100 mls wash liquor at 0.5% Dry Weight to 9, preferably 1 ml e.g. 4.7 to 8.6 mls; the at least one predominantly aqueous liquid phase contains sufficient Electrolyte to provide a concentration of at least 0.3 preferably at least 0.5, more preferably at least 1.2 e.g. 2.0 to 4.5 grams ion per liter of total alkali metal and/or ammonium cations;

the concentration of Electrolyte is greater than that corresponding to the First Conductivity Minimum of the graph of Conductivity against Electrolyte concentration; the Conductivity is no more than 2 mS greater than the Conductivity at the First Conductivity Minimum; the concentration of Electrolyte is below that which causes the formation of a substantial proportion of Lamellar phase; the Electrolyte concentration is above the minimum which provides a Stable, and preferably above the minimum which provides a Shear Stable, composition; the composition is Non-Shear Sensitive; the composition is Temperature Stable; the composition is Stable at 40° C.; the Conductivity of the composition is below 15 millisiemens per cm; the compositions contain at least 15% by weight, preferably more than 20% by weight of Builder; the Builder is at least predominantly sodium tripolyphosphate; the Builder comprises alkali metal silicate and/or carbonate, preferably sodium silicate and/or sodium carbonate; the Viscosity of the composition at a shear rate of $136^{-1}$ is between 0.1 and 2 Pascal Seconds, preferably between 0.2 and 1 Pascal seconds e.g. 0.3 to 0.6 Pascal seconds; the composition has a Yield Point preferably of at least 1, more preferably at least 1.5; e.g. at least 2, preferably less than 30, e.g. less than 20, preferably less than 15, usually less than 10 dynes/sq cm; a phase containing Builder comprises solid particles having a maximum particle size below the limit at which the particles tend to sediment; the composition is Shear Stable; the Active Ingredients include at least two components one of which is a non-ethoxylated anionic surfactant and the other a surfactant which forms stable foams such as an ether sulphate, alkanolamide or amine oxide.

INTERACTIONS OF ELECTROLYTE AND SURFACTANTS

When the concentration of dissolved Electrolyte in an appropriate aqueous surfactant mixture is progressively increased from zero, the composition typically passes through a series of easily recognised stages, as follows.

Stage I

At first the Conductivity rises to a maximum, during which stage the Viscosity rises and the initially clear, optically isotropic $L_1$ phase begins to show evidence of the formation of Spherulites. The latter are visible under the microscope, and show the so-called "Maltese Cross" texture, normally associated with spherulitic "G" phases, when viewed between crossed polarisers. However, neutron diffraction shows no evidence of a "G" phase or any other liquid crystal phase, and is consistent with a substantially micellar composition.

The compositions of Stage I are, in general, clear and stable, but have no capacity to suspend solid particles.

Stage II

In the second stage the Conductivity falls with increasing Electrolyte concentration and the composition becomes turbid. High G Centrifuging separates the composition into a clear aqueous phase and an opaque "emulsion phase", the volume proportion of the latter phase increasing with increasing Electrolyte concentration. Under the microscope, Spherulites are observed to be increasingly numerous and smaller in size and to aggregate into loose flocs separated by optically isotropic regions, which flocs become more crowded as the Electrolyte concentration increases.

Neutron diffraction studies are consistent with reduced micellar concentrations and an increasing proportion of larger bodies, but not with the presence of any significant proportion of "G" phase. The compositions of stage II are turbid, and unstable and sediment rapidly.

Stage III

The Conductivity falls to a minimum and then begins to rise. The spaces between the Spherulite flocs disappear and the Spherulites form a space-filling floc extending throughout the liquid phase. High G Centrifuging does not separate an aqueous phase, even when continued for 90 minutes. A Yield Point is observed, rising to a maximum, and the composition becomes shear thinning with a marked Viscosity Drop.

Neutron diffraction provides no evidence of any substantial proportions of Lamellar Phase. Nuclear magnetic resonance similarly provides no indication of any substantial "G" phase content and indicates a low concentration of micellar surfactant. Electron microscopy indicates that at least some of the Spherulites are Multiple Vesicles with a substantially concentric arrangement of shells or overlapping partial shells, possibly spaced more broadly than in a normal G phase.

Compositions in Stage III are Stable and capable of suspending solid particles to form a Stable suspension. Such Stage III compositions constitute our invention.

Stage IV

Further addition of dissolved Electrolyte causes a progressive diminution in the size of the Spherulites and an intensification in the brightness of the "Maltese Cross" texture. The Spherulites cease to be space filling and form discrete flocs, separated by optically isotropic regions. The Yield Point and Viscosity Drop decline and Conductivity rises to a maximum or begins to level out. Neutron diffraction provides evidence of substantial "G" phases. High G Centrifuging separates a clear Lye Phase from a turbid layer. The composition is unstable, tending to sediment and is unable to suspend solid particles.

Stage V

A Lamellar Composition is formed of the type described in E.P. No. 0086614. Viscosity, when the water content is adjusted to the extent required to give a Stable composition, is relatively high.

The foregoing sequence is typical of the interactions of Electrolytes with a wide variety of aqueous surfactant mixtures. Where the composition already contains some dissolved Electrolyte, as in a built detergent containing suspended tripolyphosphate, or where the initial surfactant mixture is not fully soluble in water, the first stage may not be observed. Similarly, where the solubility of the Electrolyte is limited, as, for example, in the case of sodium tripolyphosphate or sodium carbonate, addition of further Electrolyte above its saturation limit will not take the composition any further in the sequence.

The preferred compositions of the present invention lie within the third stage of the above sequence. Between the third stage and the second and fourth stages, respectively, there exist intermediate compositions which are semi-stable. Such compositions exhibit a floc of surfactant Spherulites, which are not completely space-filling as evidenced by the fact that High G Centrifuging continued for 90 minutes results in the formation of a clear aqueous layer, or in which the Spherulites are capable of being irreversibly disrupted. Such compositions, although they may be Stable when allowed to stand at ambient temperature, are often unstable when exposed to various kinds of stress such as high Shear stress, elevated or depressed temperatures of pH changes. Their capacity to suspend particulate solids is often limited. A number of proposed prior art compositions lie in these semi-stable areas.

We have discovered that in general compositions which lie within these semi-stable "borderline" areas may be modified in accordance with the teaching of this patent, by adjusting the Electrolyte and/or Active Ingredient content to bring them more closely into line with the Stable areas of Stage III.

Usually, on Centrifuging, the Stage III compositions of the present invention separate into an aqueous layer containing Electrolyte and from 90 to 50% by weight of the total Active Ingredients, typically 80%–50%, more usually 75% to 55%, e.g. 70% to 55% of the total Active Ingredients, and at least one other layer, said at least one other layer preferably containing from 20% to 50% by weight of the total Active Ingredient together with a substantial proportion of the Builder. Viscosities of our compositions at a shear rate of 136 $sec^{-1}$ are typically between 0.1 and 2, preferably 0.2 and 1.5, e.g. 0.25 and 0.6 Pascal Seconds, and the Viscosity Drop is typically between 0.4 and 2, e.g. 0.45 to 1.5 Pascal Seconds.

Stage III compositions are Non-Shear Sensitive and usually Shear Stable. In contrast, high shear forces tend to render the semi-stable borderline compositions unstable. The viscosity is often substantially increased by even moderate shear and they may undergo rapid sedimentation. This can present practical difficulties during manufacture and bottling. Stage III compositions of our invention are generally stable to high pH and to storage at temperatures around 40° C. or below 5° C., unlike many semi-stable compositions. They are typically Temperature Stable, when heated to 100° C.

Stage III compositions typically show no evidence of a Lamellar Phase on analysis by neutron diffraction, although some compositions near the borderline with Stage IV may show evidence of minor amounts of "G" phase.

PROPOSED STRUCTURE

We believe that the foregoing behaviour can most readily be explained on the assumption that the surfactant is progressively transferred from the micellar to a spherulitic phase with increasing Electrolyte concentration. We believe that the Spherulites initially take the form of Multiple Vesicles in which a plurality of Bilayers are arranged substantially concentrically, but with a wider and more irregular spacing than in a conventional "G" phase.

It is possible that two aqueous phase exist, an $L_1$ and a Lye Phase, which latter phase may also be an $L_1$ Phase containing fewer micelles and more Electrolyte than the former. One of these phases, possibly the Lye Phase, may form the internal phase of the Vesicles.

We have found that increasing the Electrolyte content and decreasing the proportion of Active Ingredients tends to provide compositions which are less viscous for equivalent stability and solid Pay Load. We believe that this reduces the proportion of micellar surfactant without substantially reducing the amount of the Spherulites. The lower micellar content reduces the Viscosity, while the Spherulitic phase remains sufficient to maintain stability.

We believe that in the preferred, Stable composition of our invention the Spherulites are sufficiently closely packed to form an aggregated floc which is substantially space-filling, that is it extends throughout the volume of the liquid. The Spherulites probably interact to form a weak three dimensional matrix sufficiently strong to support suspended particles, but weak enough to break down and flow readily under the influence of shear forces, and to reform when they are withdrawn. The size of the Spherulites appears to correlate with stability compositions with large Spherulites of 5 microns and more being less stable than those in which the majority of surfactant is in Spherulites of from 0.5 to 5 microns.

As the Electrolyte content increases the Spherulites become smaller and possibly more compact, tending to the closer, more regular spacing of a Spherical "G" phase. As a result the "G" phase Spherulites are no longer space filling and the composition becomes prone to sedimentation.

ACTIVE INGREDIENTS

The compositions of our invention preferably contain at least 5%, less than 30% and generally less than 25% by weight of surfactants. More preferably the surfactant constitutes from 5 to 20% by weight of the composition, e.g. 8 to 15% by weight, typically 10 to 14.5% especially preferably, less than 14, often less than 13%.

The concentration of Active Ingredients may be a critical factor is obtained compositions of our invention. Below a certain minimum which varies according to the particular Active system, the composition cannot be stabilised by adding more Electrolyte, however, the maximum is also important in order to avoid instability and/or excessively viscous compositions.

Prior art semi-stable Spherulitic Compositions have often contained relatively high amounts of Active Ingredients. This has resulted in a relatively high Viscosity of the aqueous suspending medium, which in turn has severely limited the amount of Builder which could be suspended for any given acceptable limit of Viscosity. Thus the overall Builder to Active ratio has been low compared to powders, with consequent poor washing performance.

It was highly unobvious that the Active Ingredients in such compositions could be reduced without destabilising the systems totally. We have surprisingly discovered that if the Electrolyte concentration is sufficiently raised, the concentration of Active Ingredient may be substantially reduced, to provide aqueous media of equivalent or even greater stability and yet having lower Viscosity. Such media can suspend greater amounts of Builder without losing adequate mobility and the resulting big increases in the ratio of Builder to Active Ingredient produce equally substantial increases in cost effectiveness.

In general it is substantially easier to prepare spherulitic flocs from mixed surfactants than single surfactants. Thus mixtures of one or more non-ethoxylated anionic surfactant such as alkyl benzene sulphonate and/or alkyl sulphate with one or more cosurfactants which form stable foams such as alkyl ether sulphates and/or alkanolamides or amine oxides, are generally more suitable than any of the surfactants on their own. Minor amounts of ethoxylated non-ionic surfactants, or of amphoteric surfactants, or cationic fabric softeners, may additionally be present.

The surfactant mixture may for example comprise one or more at least sparingly water-soluble salts of sulphonic or mono esterified sulphuric acids e.g. an alkylbenzene sulphonate, alkyl sulphate, alkyl ether sulphate, olefin sulphonate, alkane sulphonate, alkylphenol sulphate, alkylphenol ether sulphate, alkylethanolamide sulphate, alkylethanolamide ether sulphate, or alpha sulpho fatty acid or its esters each having at least one alkyl or alkenyl group with from 8 to 22, more usually 10 to 20, aliphatic carbon atoms. Said alkyl or alkenyl groups are preferably straight chain primary groups but may optionally be secondary, or branched chain groups. The expression "ether" hereinbefore refers to polyoxyethylene, polyoxypropylene, glyceryl and mixed polyoxyethylene-oxy propylene or mixed glyceryloxyethylene or glyceryl-oxy propylene groups, typically containing from 1 to 20 oxyalkylene groups. For example, the sulphonated or sulphated surfactant may be sodium dodecyl benzene sulphonate, potassium hexadecyl benzene sulphonate, sodium dodecyl dimethyl benzene sulphonate, sodium lauryl sulphate, sodium tallow sulphate, potassium oleyl sulphate, ammonium lauryl monoethoxy sulphate, or monoethanolamine cetyl 10 mole ethoxylate sulphate.

Other anionic surfactants useful according to the present invention include paraffin sulphonates, olefin sulphonates, fatty alkyl sulphosuccinates, fatty alkyl ether sulphosuccinates, fatty alkyl sulphosuccinamates, fatty alkyl ether sulphosuccinamates, acyl sarcosinates, acyl taurides, isethionates, Soaps such as stearates, palmitates, resinates, oleates, linoleates, and alkyl ether carboxylates. Anionic phosphate esters may also be used. In each case the anionic surfactant typically contains at least one aliphatic hydrocarbon chain having from 8 to 22 preferably 10 to 20 carbon atoms, and, in the case of ethers one or more glyceryl and/or from to 20 ethyleneoxy and or propyleneoxy groups.

Preferred anionic surfactants are sodium salts. Other salts of commercial interest include those of potassium, lithium, calcium, magnesium, ammonium, monoethanolamine, diethanolamine, triethanolamine and alkyl amines containing up to seven aliphatic carbon atoms.

The surfactant mixture may optionally contain nonionic surfactants. The nonionic surfactant may be e.g. a $C_{10-22}$ alkanolamide of a mono or di-lower alkanolamine, such as coconut monoethanolamide. Other nonionic surfactants which may optionally be present, include ethoxylated alcohols, ethoxylated carboxylic acids, ethoxylated amines, ethoxylated alkylolamides, ethoxylated alkylphenols, ethoxylated glyceryl esters, ethoxylated sorbitan esters, ethoxylated phosphate esters, and the propoxylated or ethoxylated and propoxylated analogues of all the aforesaid ethoxylated nonionics, all having a $C_{8-22}$ alkyl or alkenyl group and up to 20 ethyleneoxy and/or propyleneoxy groups, or any other nonionic surfactant which has hitherto been incorporated in powder or liquid detergent compositions e.g. amine oxides. The latter typically have at least one $C_{8-22}$, preferably $C_{10-20}$ alkyl or alkenyl group and up to two lower (e.g. $C_{1-4}$, preferably $C_{1-2}$) alkyl groups.

The preferred Active Ingredients or mixtures for our invention are for example those having an HLB greater than 7, preferably greater than 8, more preferably greater than 10, most preferably greater than 12 and preferably less than 18, more preferably less than 16, most preferably less than 15.

Certain of our detergents may contain cationic surfactants, and especially cationic fabric softeners and/or bactericides usually as a minor proportion of the total active material. Cationic fabric softeners of value in the invention include quaternary amines having two long chains (e.g. $C_{12-22}$ typically $C_{16-20}$) alkyl or alkenyl groups and either two short chains (e.g. $C_{1-4}$) alkyl groups, or one short chain and one benzyl group. They also include imidazoline and quaternised imidazolines having two long chain alkyl or alkenyl groups, and amido amines and quaternised amido amines having two long chain alkyl or alkenyl groups. The quaternised softeners are all usually salts of anions which impart a measure of water dispersibility such as formate, acetate, lactate, tartrate, chloride, methosulphate, ethosulphate, sulphate or nitrate. Compositions of our invention having fabric softener character may contain smectite clays.

Compositions of our invention may also contain amphoteric surfactant, which may be included typically in surfactants having cationic fabric softener, but may also be included, usually as a minor component of the Active Ingredients, in any of the other detergent types discussed above.

Amphoteric surfactants include betaines, sulphobetaines and phosphobetains formed by reacting a suitable tertiary nitrogen compound having a long chain alkyl or alkenyl group with the appropriate reagent, such as chloroacetic acid or propane sultone. Examples of suitable tertiary nitrogen containing compounds include: tertiary amines having one or two long chain alkyl or alkenyl groups, optionally a benzyl group and any other substituent a short chain alkyl group; imidazoline having one or two long chain alkyl or alkenyl groups and amidoamines having one or two long chain alkyl or alkenyl groups.

Those skilled in the detergent art will appreciate that the specific surfactant types described above are only exemplary of the commoner surfactants suitable for use according to the invention. Any surfactant capable of performing a useful function in the wash liquor may be included. A fuller description of the principal types of surfactant which are commercially available is given in the current edition of "McCutcheon's Emulsifiers & Detergents", published by the McCutcheon division of Manufacturing Confectioners Publishing Company.

ELECTROLYTE

Electrolyte is essential in order to interact with the surfactant to form a space-filling spherulitic system. The Electrolyte concentration is preferably not, however, sufficient to permit substantial stacking of any planar Bilayers, to form non-spherical Lamellar Phases. Such Lamellar Phases may provide non-Stable or Shear Unstable compositions, unless the Pay Load is sufficiently high for the Lamellar Phase to form a stable structure according to E.P. No. 008614A, The relatively strong matrix which characterises the latter compositions, however, generally results in undesirably high Viscosity. For a suitable surfactant system at a suitable concentration, we have found that it is possible to stabilise the system in accordance with an our invention by including in the composition a suitable quantity of Electrolyte.

Insufficient Electrolyte results in unstable, or shear, or temperature sensitive systems and/or in systems having undesirably high Viscosity. The proportion of Electrolyte must therefore be selected according to the nature of the surfactant and the amount of any Hydrotrope present to provide compositions according to the present invention.

The optimum proportion of Electrolyte may generally be determined by making progressive additions of Electrolyte to an aqueous, micellar solution of the Active Ingredients (typically about 15 to 20% by weight Active) and observing one or more of several characteristic properties of the system such as turbidity, Conductivity, Yield Point, appearance under the polarising microscope or with phase contrast or differential interference contrast, or behaviour on High G Centrifuging.

When the properties characteristic of Stage III as described hereinbefore are detected, e.g. a turbid composition at, or near a First Conductivity minimum, with a Floc of Spherulites showing no clear isotropic areas and showing no clear layer on High G Centrifuging, then the spherulitic range has been identified.

The proportion may be optimised within this range by observing the amount required to obtain no clear layer on High G Centrifuging for 90 minutes, and/or provide Temperature Stable and/or Shear Stable compositions. If the composition is intended for a market in which low Viscosity is of primary importance, the optimised composition may be progressively diluted until a suitable Viscosity is achieved or signs of instability are observed. If the latter occurs, further additions of Electrolyte may be made until a sufficiently stable composition has been obtained.

The amount of Electrolyte is preferably greater than that at the First Conductivity Minimum in the Conductivity/Electrolyte concentration graph and corresponds to the amount required to provide a composition having a Yield Point greater than 1.5 dynes $cm^{-2}$.

We prefer to use Functional Electrolytes such as carbonates, silicates, pyrophosphates, polyphosphates, nitriloacetates and citrates, all of which are Builders, but the effective concentration of some such Electrolytes, e.g. carbonates, may be undesirably limited by their solubility. In such cases it may prove necessary to add a more soluble Non-Functional Electrolyte. Sodium chloride and sodium nitrate have been found particularly effective in this respect.

Often, the proportion of Electrolyte in the at least one predominantly aqueous phase is sufficient to provide a concentration of at least 0.3 preferably at least 1.2 e.g. 2.0 to 4.5 gram ions per liter of alkali metal, alkaline earth metal and/or ammonium cations.

BUILDERS

The Builder, in preferred compositions of our invention is believed to be normally present, at least partially, as discrete solid crystallites suspended in the composition. The crystallites typically have a size of up to 60 eg 1 to 50 microns.

We have found that Formulations containing sodium tripolyphosphate as Builder, or at least a major proportion of sodium tripolyphosphate in admixture with other Builders, exhibit stability and mobility over a wider range of Dry Weight than corresponding Formulations with other Builders. Such formulations are therefore preferred. Our invention, however, also provides compositions comprising other Builders such as potassium tripolyphosphate, carbonates, zeolites, nitrilo triacetates, citrates, metaphosphates, pyrophosphates, phosphonates, EDTA and/or polycarboxylates, optionally but preferably, in admixture with tripolyphosphate. Orthophosphates may be present, preferably as minor components in admixture with tripolyphosphate, as may alkali metal silicates and carbonates.

Silicates and carbonates are particularly preferred since they perform several valuable functions. They provide the free alkalinity desirable to saponify fats in the soil, they have an effect as Builders, and in the case of silicates, they inhibit corrosion of aluminium surfaces in washing machines. In addition, they are effective as Electrolytes necessary to form a spherulitic system.

Typically, where silicate is used to prepare our compositions it has an $Na_2O:SiO_2$ ratio of from 1:1 to 1:2 or 1:1.5 to 1:1.8. It will however be appreciated that any ratio of $Na_2O$ (or other base) to $SiO_2$, or even silicic acid, could be used to provide the silicate in the composition, and any necessary additional alkalinity provided by addition of another base such as sodium carbonate or hydroxide. Formulations not intended for use in washing machines do not require silicates provided that there is an alternative source of alkalinity.

We do not exclude compositions wherein the Builder is present substantially entirely in solution, e.g. sodium nitrilo triacetate, sodium citrate, sodium silicate or mixtures thereof.

The Builder normally constitutes at least 15% by weight of the compositions, preferably at least 20%. We prefer that the ratio of Builder to surfactant is greater than 1:1 preferably 1.2:1 to 4:1.

CATIONS

On economic grounds it is generally preferred that the cations present should consist, at least predominantly, of sodium. Thus, for example, the preferred Builder is sodium tripolyphosphate, the preferred anionic surfactants are sodium salts of sulphated or sulphonated anionic surfactants and any anti-redeposition agent, e.g. carboxymethyl cellulose, or alkali, e.g. silicate or carbonate are also preferably present as the sodium salts. Sodium chloride, sodium nitrate or other soluble inorganic sodium salts may be added to increase the Electrolyte concentration. Calcium is only normally present when the Active Ingredients comprise surfactants, such as olefin sulphonates or non-ionics which are tolerant of its presence. Magnesium salts may be present, and are more compatible with surfactants than is calcium.

It is possible, alternatively, but less preferably to choose salts of potassium, ammonium, lower amines, alkanolamines or mixed cations. Compositions containing high proportions of such cations are, however, unlikely to be cost effective in comparison with conventional laundry powders.

ALKALINITY

The compositions of our invention are preferably alkaline, being desirably buffered with an alkaline buffer to provide a pH in the composition as measured on a glass electrode, above 8.5 preferably above 9, most preferably above 9.2, e.g. 9.5 to 12 especially 10 to 11. We particularly prefer that our compositions should be adapted to provide a pH of greater than 9.7, e.g. greater than 10, especially 10.5 to 11.5 in a wash liquor containing the composition diluted to 0.5% Dry Weight. They desirably have sufficient free alkalinity to require at least 0.4 mls, preferably at least 0.8 mls, most preferably 1 to 12 mls, e.g. 3 to 10 mls, typically 4 to 9 mls of N/10 HCl to reduce the pH of 100 mls. of a dilute solution of the composition, containing 0.5% Dry Weight, to 9, although compositions having higher alkalinity may also be commercially acceptable. In general, lower alkalinities are less acceptable in commercial practice, although not excluded from the scope of our invention.

The alkaline buffer is preferably sodium tripolyphosphate and the alkalinity is preferably provided at least in part by sodium carbonate. Other preferred alkaline buffers include sodium silicate.

SOLUBILISERS

Hitherto, liquid detergent compositions have commonly contained substantial concentrations of Hydrotropes and/or organic, water-miscible hydroxylic solvents such as methanol, ethanol, isopropanol, glycol, glycerol, polyethylene glycol and polypropylene glycol. They are, however, costly and not Functional Ingredients. They may, in certain circumstances promote pourability or permit a surfactant to form a spherulitic phase more readily. We do not therefore totally exclude them from all compositions of our invention, but we prefer that their presence be limited to the minimum required to ensure a Spherulitic Composition of adequate Pourability. If not so required we prefer that they be absent. Solvents may sometimes need to be accommodated as components of perfumes or other of the Usual Minor Ingredients.

DRY WEIGHT

The Dry Weight of the composition affects stability and Pourability. Optimum Dry Weight may vary considerably from one type of Formulation to another and may be selected to provide the required Viscosity. Generally speaking it has not been found possible to guarantee Stable compositions below about 35% by weight Dry Weight, although some types of Formulation can be obtained in a Stable form below 30% Dry Weight, and sometimes as low as 25% Dry Weight. We do not exclude the possibility of making Stable Compositions at Dry Weights down to 20%.

For any given Formulation according to our invention a range of Dry Weights can be identified within which the composition is both Stable and Pourable. Generally below this range, sedimentation occurs and above the range, the Formulation is either unstable or too viscous. The acceptable range may be routinely determined for any given Formulation by preparing the suspension using the minimum water required to maintain a stirrable composition, diluting a number of samples to progressively higher dilutions, and observing the samples for signs of sedimentation over a suitable period. For some Formulations the acceptable range of Dry Weights may extend from 30% or 35% to 60 or even 70% by weight for others it may be much narrower, e.g. 40 to 45% by weight.

If no Stable Pourable range can be determined by the above methods, the Formulation should be modified according to the teaching herein e.g. by the addition of more sodium carbonate, sodium silicate solution or other Electrolyte if the composition exhibits Stage I or II properties, or by reducing the Electrolyte content or adding Hydrotrope if the composition exhibits Stage IV or V properties. Alternatively, if difficulty is encountered in finding a Stable Spherulitic system by merely altering the Electrolyte content, the Active Ingredients may be modified by adding a foam stabilising surfactant, such as alkyl ether sulphate, alkanolamide or amine oxide, if the composition tends to form Stage IV or V or by adding alkyl benzene sulphonate or alkyl sulphate or other non-ethoxylated anionic surfactant if Stage I or Stage II properties predominate.

PREPARATION

Compositions of our invention can, in many instances be readily prepared by normal stirring together of the ingredients. It is a characteristic of our preferred composition, however, that they are not destabilised or thickened by subjection to high shear forces.

The order and conditions of mixing the ingredients are sometimes important in preparing a stable structured mixture according to our invention.

Compositions according to our invention may be typically obtained for any suitable Active Ingredients by first preparing a clear aqueous $L_1$ solution of the Active Ingredients at a suitable concentration (e.g. 15 to 30% by weight Active) with warming, if necessary, and dissolving Electrolyte in the $L_1$ solution or adding concentrated Electrolyte solution (preferably Functional Electrolyte) until the mixture becomes opaque. A sample of the mixture is then centrifuged at 20,000G for 5 minutes. If a clear aqueous phase is observed, more Electrolyte is added to the mixture until High G Centrifuging no longer gives evidence of a separate, substantially clear, aqueous phase. The weight ratio of Active Ingredient to dissolved Electrolyte is then noted.

A composition containing all the desired Ingredients and having the Active Ingredient to Electrolyte weight ratio already determined may then be prepared at the desired Percentage Dry Weight (typically 40 to 50%). Formation of a clear aqueous Lye phase on High G Centrifuging indicates the presence of Lamellar or non-space filling Spherical "G" Phase and the amount of Electrolyte is then reduced until no clear phase is observed on High G Centrifuging. Samples of the latter Formulation at different Dry Weights may be prepared to determine the optimum balance of Pay Load/-mobility/stability characteristics. If, on dilution to a desired, low Viscosity, the stability is inadequate, it may often be restored by adding more Electrolyte.

If difficulty is experienced locating a suitable Active/Electrolyte ratio in the first stage of the above operation the procedure may be repeated using a more soluble Electrolyte, e.g. a non-Functional Electrolyte such as sodium chloride or sodium nitrate. Alternatively, the Active system may be modified by addition of surfactants which favour stable dispersions according to our invention, e.g. ether sulphates, amine oxides or alkanolamides, if Stage IV or V properties are observed, or a non-ethoxylated anionic surfactant if Stage I or II properties are more readily obtained. The proportions of surfactant may be adjusted until a mixture is obtained that forms a Stable, turbid composition when a proportion of Electrolyte is added corresponding to a First Conductivity Minimum.

Typically, mixing is carried out at ambient temperature where consistent with adequate dispersion, certain ingredients, e.g. non-ionic surfactants such as coconut monoethanolamide require gentle warming e.g. 40° for adequate dispersion. This degree of warming may generally be achieved by the heat of hydration of sodium tripolyphosphate. To ensure sufficient warming we prefer to add the tripolyphosphate in the anhydrous form containing a sufficiently high proportion of the high temperature rise modification commonly called "Phase I". The foregoing procedure is only one of several methods that may be satisfactorily used for all or most of the compositions of our invention. Some Formulations are more sensitive to the order and temperature of mixing than others. We have found that it is sometimes advantageous to premix solid components, such as tripolyphosphate and carbonate.

FORMULATIONS

Formulations are typically based on mixtures of ne or more non-ethoxylated anionic surfactant, preferably a sulphated or sulphonated surfactant, with one or more cosurfactant which forms a stable foam such as an ethoxylated anionic surfactant, an amine oxide or a fatty alkanolamide. The first component of the Active Ingredients, i.e. the the non ethoxylated anionic surfactant may for example be a $C_{10-18}$ alkyl sulphate and/or $C_{10-14}$ alkyl benzene sulphonate. The second component or cosurfactant may be a sodium $C_{10-20}$ straight or branched chain alkyl $C_{1-10}$ mole ether sulphate or an alkyl phenol ether sulphate, amine ether sulphate, alkanolamide ether sulphate or fatty acid ether sulphate. Alternatively or additionally, the second component may comprise an amine oxide or fatty alkylolamide. The total proportion by weight of non-ethoxylated anionic to cosurfactant may typically be from 5:1 to 1:3, preferably 4:1 to 1:2, e.g. 3:1 to 1:1. Small amounts (e.g. up to 1% of the weight of the compositions) of Soap may be present to aid rinsing of the fabric. Nonionic ethoxylates may be present in minor proportions, typically up to 20% by wt. of the total Active Ingredients, preferably less than 15%, usually less than 10%.

The sodium alkyl sulphate or alkyl benzene sulphonate may be totally or partially replaced, in the above Formulations by other sulphonated, non-ethoxylated surfactants including fatty alkyl xylene or toluene sulphonates, or by paraffin sulphonates, olefin sulphonates, sulphocarboxylates, and their esters and amides, including sulphosuccinates and sulphosuccinamates. The alkyl ether sulphate may be wholly or partially replaced by other ether sulphates such as alkyl phenyl ether sulphates, fatty acyl monoethanolamide ether sulphates or mixtures thereof.

According to a specific embodiment, therefore, our invention provides a Stable, Pourable, Non-Shear Sensitive Spherulitic Composition having a Pay Load of at least 35% by weight and comprising: water; from 12 to 40% Dry Weight of Active Ingredient based on the Dry Weight of the Composition and from 20 to 80% Dry Weight of Builder based on the Dry Weight of the composition, at least partly present as suspended solid and partly as at least part of said dissolved Electrolyte, in a total weight ratio of Builder to Active Ingredients of 1.3:1 to 4:1; and wherein said Active Ingredients consists of (A) from 30 to 80% by weight thereof of a non-alkoxylated anionic sulphated or sulphonated surfactant, and (B) from 20% to 70% by weight of the total surfactant of at least one foam stabilising cosurfactant such as an alkoxylated anionic surfactant, an alkanolamide or an amine oxide.

Optionally, the aforesaid composition may additionally contain up to 6% by Dry Weight of the composition of Soap. Preferably the non-alkoxylated sulphated or sulphonated anionic surfactant consists substantially of alkyl sulphate or alkyl benzene sulphonate, preferably sodium alkyl benzene sulphonate, e.g. $C_{10-14}$ alkyl benzene sulphonate. Alternatively, the anionic surfactant may comprise a mixture of alkyl benzene sulphonate, and/or alkyl sulphate with alkyl ether sulphate and/or alkyl phenol ether sulphate in weight proportions of e.g. from 1:3 to 5:1 typically 1:2 to 4:1 preferably 1:1 to 3:1 e.g. 2:1.

Low foaming compositions according to our invention may be prepared by using suitable foam-inhibitors. The choice of foam-inhibitor requires some care, since certain commercially available foam-inhibitors may lose their effectiveness on storage in compositions of our invention, while others are only effective at concentrations high enough to affect the Viscosity or Stability of the composition. We have found mixtures of organopolysiloxane and hydrophobic silica particularly effective.

Our invention provides, according to another specific embodiment, a Stable, Pourable, fluid, aqueous-based, detergent composition, comprising: from 12 to 40% based on Dry Weight thereof of Active Ingredients which comprise from 30 to 90% based on the Dry weight of the Active Ingredients of non-alkoxylated sulphated and/or sulphonated anionic surfactant and the balance of alkyl ether sulphate, alkanolamide and/or amine oxide; an aqueous phase containing sufficient Electrolyte in solution to form a space-filling Spherulitic floc comprising at least part of said Active Ingredients and Interspersed with said aqueous phase; suspended particles of Builder; an effective amount of at least one foam inhibitor and optionally the Usual Minor Ingredients.

According to a further specific embodiment our invention provides a Pourable, Stable, Non-Lamellar detergent composition having a Payload of from 30% to 50% consisting essentially of from 12 to 40% Dry Weight, based on the Dry Weight of the composition, of Active Ingredients, at least 30% Builder, based on the Dry Weight of the composition, a ratio of Builder to Active Ingredient greater than 1.1 to 1, said Active Ingredient consisting essentially of alkyl benzene sulphonate having 8 to 18 aliphatic carbon atoms and an alkyl ethanolamide selected from $C_{10-18}$ alkyl monoethanolamides and diethanolamides, in a weight ratio of alkyl benzene sulphonate to ethanolamide of from 1.5:1 to 4:1, said Builder being selected from sodium tripolyphosphate, sodium carbonate, zeolite, sodium nitrilo triacetate, sodium silicate and mixtures thereof, such that the amount of dissolved Builder is sufficient to provide a Yield Point of greater than 1.5 dynes $cm^{-1}$.

A particularly preferred embodiment of our invention provides a Pourable, Stable, liquid detergent composition, consisting essentially of:

A. A mixture of (i) a sodium alkylbenzene sulphonate having 10 to 18, preferably 10 to 14 aliphatic carbon atoms with (ii) a sodium alkyl ether sulphate having an alkyl group with an average of from 8 to 18, preferably 10 to 14 carbon atoms, and from 1 to 20, preferably 2 to 10, e.g. 3 to 5 ethylene-oxy and/or propylene-oxy groups; in ratio of (i):(II), between 10:1 and 1:10, especially 10:1.5 to 10:5, e.g. 10:2 to 10:4;

B. A Builder selected from sodium tripolyphosphate, zeolite, sodium nitrilotriacetate and mixtures thereof in a weight ratio of B:A of from 1.1:1 to 4:1, preferably 1.2:1 to 3.5:1, e.g. 2:1 to 3:1;

C. An Electrolyte selected from sodium carbonate, sodium silicate, sodium nitrate, sodium chloride and mixtures thereof in a concentration of from 2 to 20% by weight, preferably 3 to 18% by weight, especially 7 to 15% by weight of the composition; said composition having a Pay Load of 30 to 50% by weight, preferably 35 to 50% by weight, e.g. 38 to 45% by weight; and said composition preferably containing minor but effective amounts of anti-redeposition agents, preferably sodium carboxymethyl cellulose, perfume, colouring and optical brightener.

The sodium cation in the above composition may optionally, but less preferably, be replaced wholly or in part by potassium, lithium or ammonium. Preferably the sodium tripolyphosphate constitutes from 40 to 95% of the total weight of Builder, e.g. 45% to 80%. Preferably, the composition contains at least one foam-inhibitor if required for automatic washing.

The above composition may optionally contain minor proportions of alkanolamide, such as coconut monoethanolamide or diethanolamide, or of ethoxylated nonionic surfactant, e.g. up to 15% of the total Active Ingredients, preferably less than 10%.

MINOR INGREDIENTS

Compositions of the invention may contain the Usual Minor Ingredients. Principal of these are antiredeposition agents, dispersants, optical brightening agents and bleaches.

The most commonly used antiredeposition agent in making detergents is sodium carboxymethyl cellulose (SCMC), which may be present in compositions of this invention e.g. in effective amounts consistent with desired Viscosity and Stability. Generally speaking SCMC is effective at concentrations of about 1% and we prefer not to exceed the normal effective concentrations, since SCMC in greater amounts can raise the Viscosity of a liquid composition very considerably and may also affect stability.

Alternative antiredeposition and/or soil releasing agents include potassium, ammonium and other soluble CMC salts, phosphonates, methylcellulose, polyvinylpyrrolidone, carboxymethyl starch and similar poly electrolytes, including synthetic polycarboxylates such as polyacrylates all of which may be used in place of SCMC.

Optical Brighteners (OBA's) are optional, but preferred, ingredients of the compositions of our invention. Unlike some prior art formulations, our compositions are not dependent on OBA's for stability and we are therefore free to select any convenient and cost effective OBA, or to omit them altogether. We have found that any of the fluorescent dyes hitherto recommended for use as OBA's in liquid detergents may be employed, as may many dyes normally suitable for use in powder detergents. The OBA may be present in conventional amounts. Typically concentrations of OBA between 0.05 and 0.5% are sufficient e.g. 0.075 to 0.3% typically 0.1 to 0.2%. Lower concentrations could be used but are unlikely to be effective, while higher concentrations, while we do not exclude them, are unlikely to prove cost effective and may, in some instances give rise to problems of compatibility.

Typical examples of OBA's, which may be used in the present invention include: ethoxylated 1,2-(benzimidazolyl) ethylene; 2-styrylnaphth[1,2-d]oxazole; 1,2-bis(5' methyl-2-benzoxazolyl) ethylene; disodium-4,4'-bis(6-methylethanolamine-3-anilino-1,3,5-triazin-2''-yl)-2,2'-stilbene sulphonate; N-(2-hydroxyethyl-4,4'-bis(benzimidazolyl)stilbene; tetrasodium 4,4'-bis[4''-bis(2''-hydroxyethyl)-amino-6''(3''-sulphophenyl) amino-1'',3'',5''-triazin-2''-ylamino]-2,2'-stilbenedisulphonate; disodium-4-(6''-sulphonaphtho[1',2'-d]triazol-2-yl)-2-stilbenesulphonate; disodium 4,4'-bis[4''-(2'''-hydroxyethoxy)-6''-amino-1'',3'',5''-triazin-2''-yl amino]-2,2'-stilbenedisulphonate; 4-methyl-7-dimethyl aminocoumarin; and alkoxylated 4,4'-bis-(benzimidazolyl) stilbene.

Bleaches may optionally be incorporated in liquid detergent compositions of our invention subject to chemical stability and compatibility. Encapsulated bleaches may form part of the suspended solid. The action of peroxy bleaches in compositions of our invention may be enhanced by the presence of bleach activators such as tetra acetyl ethylenediamine, in effective amounts. Photoactive bleaches such as zinc or aluminium sulphonated phthalocyanin, may also be present.

Perfumes and colourings are conventionally present in laundry detergents in amounts up to 1 or 2%, and may similarly be present in compositions of our invention. Care is sometimes necessary in selecting a suitable perfume since the solvents present may modify the behaviour of the Active Ingredients.

Proteolytic and amylolitic enzymes may optionally be present in conventional amounts, together optionally with enzyme stabilizers and carriers. Encapsulated enzymes may be suspended in the composition.

Other Minor Ingredients include defoamers, alkalis, buffers, germicides such as formaldehyde, opacifiers such as vinyl latex emulsion, inert abrasives, such as silica and anticorrosives such as benzotriazole.

Compositions of our invention are, in general, suitable for laundry use and our invention provides a method of washing clothes by agitating them in a wash liquor containing any composition of the invention as described herein. Low foam compositions herein described are in particular of use in automatic washing machines. The compositions may also be used in the washing of dishes, or the cleaning of hard surfaces, the low foam products being particularly suitable for use in dishwashing machines. High foaming compositions may be of value for shampoo formulations. These constitute a further aspect of the invention.

Compositions of our invention may, generally, be used for washing clothes in boiling water, or for washing at medium or cool temperatures, e.g. 50° to 80° C., especially 55° to 68° C., or 20° to 50° C. especially 30° to 40° C., respectively. Typically the compositions may be added to the washwater at concentrations of between 0.05 and 3% Dry Weight based on the wash water preferably 0.1 to 2%, more usually 0.3 to 1% e.g. 0.4 to 0.8%.

The invention is illustrated by the examples set out in the following Tables. The Examples were stable and Pourable. They were stable to storage at 40° C. and were Non-Shear Sensitive. They were Temperature Stable and, except for Example 83, were Shear Stable.

| | Eg. 1 | Eg. 2 | Eg. 3 | Eg. 4 | Eg. 5 | Eg. 6 | Eg. 7 | Eg. 8 | Eg. 9 | Eg. 10 | Eg. 11 | Eg. 12 | Eg. 13 | Eg. 14 | Eg. 15 | Eg. 16 | Eg. 17 | Eg. 18 | Eg. 19 | Eg. 20 | Eg. 21 |
|---|---|---|---|---|---|---|---|---|---|---|---|---|---|---|---|---|---|---|---|---|---|
| Sodium $C_{10-14}$ Linear Alkyl Benzene Sulphonate | 10 | 10 | 10 | 10 | 9.3 | 10 | 10 | 9.2 | 9.3 | 9.5 | 9.3 | 10 | 10 | 10 | 9.2 | 10 | 10 | 8.7 | 9.0 | 9.1 | 9.4 |
| Coconut Diethanolamide | 5 | 5 | 5 | 5 | 2.3 | 2.5 | | | | | | | | | | | | | | | |
| Sodium Carbonate | 5 | 5 | 5 | 5 | 4.6 | 5 | 5 | 4.6 | 5.2 | 4.8 | 5.2 | 5 | 5 | 5 | 4.6 | 5 | 5 | 4.8 | 5 | 5.0 | 4.6 |
| Sodium Tripolyphosphate | 25 | 25 | 18 | 27 | 16.7 | 18 | 25 | 23.5 | 19.0 | 18.1 | 18.5 | 18 | 25 | 25 | 23.1 | 18.0 | 18.0 | 18.4 | 19.0 | 18.5 | 19.0 |
| Zeolite A | — | — | 9 | — | 9.3 | 10 | — | — | 9.0 | 8.6 | 8.8 | 10 | — | — | — | 10 | 10 | 11.6 | 11.0 | 9.0 | 10.0 |
| Sodium Carboxymethyl Cellulose | 1.0 | 1.0 | — | — | — | — | 1.0 | — | — | — | — | 0.5 | 1.0 | 1.0 | — | 1.0 | 1.0 | — | — | | |
| Sodium $C_{12-18}$ Alkyl 3 mole Ethoxy sulphate | — | — | — | — | 2.3 | 2.5 | | | | | | | 5 | 5 | 3.7 | 5 | 5 | 3.9 | 4.0 | | |
| Optical Brightening Agent | 0.15 | 0.15 | 0.15 | 0.15 | — | 0.15 | 0.15 | 0.14 | 0.14 | 0.14 | 0.14 | 0.1 | 0.15 | 0.15 | 0.14 | 0.15 | 0.15 | 0.14 | 0.15 | 0.15 | 0.15 |
| $C_{12-18}$ Alcohol 8 mole ethoxylate | — | — | — | — | — | 1.8 | | | | | | | — | 2.0 | 1.9 | 2.0 | — | — | — | — | 2.0 |
| Mixed mono and di $C_{16-18}$ alkyl phosphate | — | 0.5 | — | — | 0.5 | — | — | 0.5 | 0.5 | 0.5 | 0.5 | — | | | | | | | | | |
| Nonionic Foam Inhibitor | — | 2.0 | — | — | — | — | — | 2.6 | — | 2.2 | — | — | — | 1.9 | — | — | — | — | — | | |
| Coconut Monoethanolamide | | | | | | | 5 | 4.6 | 4.2 | 4.2 | 4.2 | 5 | | | | | | | | | |
| Silicone Defoamer | | | | | | | — | — | — | — | 1.0 | — | — | — | — | — | — | — | 0.5 | | |
| Mixed mono and di $C_{16-18}$ alkyl Phosphate Ester | | | | | | | | | | | | | — | 1.0 | 0.5 | — | — | — | — | 0.5 | 0.5 |
| Sodium $C_{12-14}$ Alkyl 3 mole Ethoxy Sulphate | | | | | | | | | | | | | | | | | | | | 4.8 | 4.0 |

| | Eg. 22 | Eg. 23 | Eg. 24 | Eg. 25 | Eg. 26 | Eg. 27 | Eg. 28 | Eg. 29 | Eg. 30 | Eg. 31 | Eg. 32 | Eg. 33 | Eg. 34 | Eg. 35 | Eg. 36 | Eg. 37 | Eg. 38 | Eg. 39 | Eg. 40 | Eg. 41 | Eg. 42 |
|---|---|---|---|---|---|---|---|---|---|---|---|---|---|---|---|---|---|---|---|---|---|
| Sodium $C_{10-14}$ Linear Alkyl Benzene Sulphonate | 9.2 | 7.8 | 8.3 | 9 | 8.6 | 10 | 8.8 | 10 | 9 | 10 | 10 | 10 | 9.5 | 9.5 | 10 | 7.4 | 8.2 | 5.0 | 6.5 | 7.0 | 6.1 |
| Sodium $C_{12-18}$ Alkyl 3 mole Ethoxy Sulphate | 9.2 | 7.8 | 4.1 | 4 | 2.3 | | | 5 | 4 | — | — | — | 2.5 | 2.5 | — | 1.9 | — | | | | |
| Sodium Carbonate | 4.6 | 3.9 | 4.2 | 5 | — | 5 | 5.8 | 10 | 15 | 7.5 | — | — | 10 | — | | | | 5.0 | 4.0 | 4.4 | 3.8 |
| Sodium Tripolyphosphate | 6.9 | 5.9 | 15.0 | 19 | 25.3 | 27 | 25.6 | — | — | — | 15 | 2.5 | — | — | | — | — | 25.0 | 20.2 | 21.9 | 19.1 |
| Sodium Nitrilo Triacetate | 13.8 | 11.7 | 8.3 | | | | | — | — | — | — | — | — | 10 | | | | | | | |
| $C_{12-18}$ Alcohol 8 mole ethoxylate | — | 1.7 | — | | | | | — | 2 | — | — | — | — | — | | | | | | | |
| Coconut diethanolamide | 1.8 | 1.6 | — | | | | | — | — | 5 | 5 | — | — | — | | | | 4.0 | 4.8 | 3.5 | 3.8 |
| Coconut Monoethanolamide | | | | — | 1.4 | — | 1.5 | — | — | — | — | 5 | 1.5 | 1.5 | 5 | 1.2 | 4.1 | | | | |
| Zeolite A | | | | 5 | — | | | 22 | 17 | 24.5 | 17 | 30 | 22 | 22 | 17 | 24.8 | 26.4 | 8.0 | — | — | — |
| Sodium Carboxymethyl Cellulose | | | | — | 1.4 | | | | | | | | | | | | | 1.0 | 0.8 | 0.9 | 0.8 |
| Optical Brightening Agent | | | | 0.15 | 0.13 | — | 0.14 | | | | | | | | | | | 0.15 | 0.12 | 0.13 | 0.11 |
| Sodium Silicate ($SiO_2$:$Na_2O$, 1.6:1) | | | | 5 | 5.8 | | | | | | | | | | — | 11.6 | 8.2 | | | | |
| Silicone Defoamer | | | | 1 | — | 1 | — | | | | | | | | | | | — | 1.0 | 1.0 | 1.0 |
| $C_{12-14}$ Alkyl Dimethylamine Amine Oxide | | | | | | 5 | 2.3 | | | | | | | | | | | | | | |
| 2-tallow-1-methyl-1-(tallow-amidoethyl) imidazoline methyl sulphate | | | | | | | | | | | | | | | | | | 0.75 | 0.6 | 2.0 | 1.1 |
| Mixed mono and di $C_{16-18}$ alkyl phosphate | | | | | | | | | | | | | | | | | | 0.5 | — | — | — |

-continued

| | Eg. 43 | Eg. 44 | Eg. 45 | Eg. 46 | Eg. 47 | Eg. 48 | Eg. 49 | Eg. 50 | Eg. 51 | Eg. 52 | Eg. 53 | Eg. 54 | Eg. 55 | Eg. 56 | Eg. 57 | Eg. 58 | Eg. 59 | Eg. 60 | Eg. 61 | Eg. 62 | Eg. 63 |
|---|---|---|---|---|---|---|---|---|---|---|---|---|---|---|---|---|---|---|---|---|---|
| Sodium $C_{10-14}$ Linear Alkyl Benzene Sulphonate | 10.9 | 5.2 | 8.0 | 8.8 | 10.0 | 10.0 | 9.5 | 10.0 | 10.0 | 10.0 | 10.6 | 10.6 | 10.6 | 10.6 | 10.6 | 10.6 | 9.3 | 9.3 | 9.5 | 9.4 | 8.9 |
| Coconut Diethanolamide | 3.0 | 7.0 | 6.0 | | | | — | — | 5.0 | 5.0 | | | | | | | 3.5 | 3.5 | 2.4 | 2.75 | 5.2 |
| Sodium Carbonate | 5.0 | 4.3 | 4.8 | 4.4 | — | — | — | — | 5.0 | 5.0 | — | 4.6 | — | — | 4.6 | 4.6 | 5.8 | 5.8 | 5.9 | 5.9 | 5.6 |
| Sodium Tripolyphosphate | 24.7 | 21.7 | 18.1 | 16.7 | 19.0 | 19.0 | 18.1 | 19.0 | 25.0 | 25.0 | 13.7 | 14.9 | 13.7 | 13.7 | 14.9 | 14.9 | 29.0 | 18.0 | 29.7 | 29.5 | 27.8 |
| Zeolite A | — | — | 8.6 | 7.9 | 9.0 | 9.0 | 8.6 | 9.0 | — | — | 9.0 | 10.0 | 9.0 | 9.0 | 10.0 | 10.0 | — | 11.0 | — | — | — |
| Sodium Carboxymethyl Cellulose | 1.0 | — | — | | | | — | — | 1.0 | 1.0 | 1.0 | 1.0 | — | 1.0 | 1.0 | — | — | — | — | — | — |
| 2-tallow-1-methyl-1-(tallow-amidoethyl) imidazoline methyl sulphate | 0.75 | 0.65 | 0.75 | | | | | | | | | | | | | | | | | | |
| Optical Brightening Agent | 0.15 | 0.13 | 0.14 | 0.13 | 0.15 | 0.15 | 0.14 | 0.15 | 0.15 | 0.15 | 0.14 | 0.14 | 0.14 | 0.14 | 0.14 | 0.14 | 0.14 | 0.14 | 0.14 | 0.14 | 0.14 |
| Mixed mono and di $C_{16-18}$ alkyl phosphate | — | 0.43 | 0.5 | 0.44 | 0.5 | 0.5 | 0.5 | 0.5 | — | — | | | | | | | | | | | |
| Silicone Defoamer | 1.0 | — | — | | | | | | | | 1.0 | 1.0 | — | — | — | — | | | | | |
| Coconut Monoethanolamide | | | | 3.5 | 4.0 | 4.0 | 4.2 | 4.0 | — | — | 2.5 | 1.7 | 2.5 | 2.5 | 1.7 | 1.7 | | | | | |
| Sodium Silicate ($SiO_2$:$Na_2O$, *1:1, **1.6:1) | | | | — | 5.0* | 5.0** | | | | | | | | | | | | | | | |
| Trisodium Sulphosuccinate | — | — | 1.0 | | | | | | | | | | | | | | | | | | |
| Sodium ethylenediamine tetrakis (methenophosphonate) | — | — | — | | | | | | | | | | | | | | | | | | |
| Trisodium Orthophosphate | 2.9 | 5.0 | — | | | | | | | | | | | | | | | | | | |
| Sodium Silicate ($SiO_2$:$Na_2O$, 1.6:1) | | | | | | | | | | | 6.4 | — | 6.4 | 6.4 | — | — | | | | | |
| Sodium $C_{12-18}$ Alkyl 3 mole Ethoxy Sulphate | | | | | | | | | | | 0.7 | 1.2 | 0.7 | 0.7 | 1.2 | 1.2 | | | | | |

| | Eg. 64 | Eg. 65 | Eg. 66 | Eg. 67 | Eg. 68 | Eg. 69 | Eg. 70 | Eg. 72 | Eg. 73 | Eg. 74 | Eg. 75 | Eg. 76 | Eg. 77 | Eg. 78 | Eg. 79 | Eg. 80 | Eg. 81 | Eg. 82 | Eg. 83 | Eg. 84 |
|---|---|---|---|---|---|---|---|---|---|---|---|---|---|---|---|---|---|---|---|---|
| Sodium $C_{10-14}$ Linear Alkyl Benzene Sulphonate | 9.2 | 9.2 | 9.1 | 7.9 | — | — | — | 2.85 | 2.2 | | 8.4 | 7.0 | 7.0 | 6.0 | 9.0 | 14.2 | 9.6 | 7.4 | 5.0 | 9.0 |
| Coconut Diethanolamide | 3.5 | 3.5 | 3.4 | 1.8 | 3.2 | 3.0 | 3.3 | 3.65 | 3.7 | | — | — | — | 2.0 | 0.9 | — | — | — | — | — |
| Sodium Carbonate | 5.8 | 5.8 | 5.7 | 5.8 | 4.2 | 4.9 | 2.4 | | | 5.0 | 4.6 | 5.0 | 5.0 | 7.5 | 6.8 | 6.6 | — | 6.9 | 4.2 | 7.5 |
| Sodium Tripolyphosphate | 28.9 | 28.8 | 17.1 | 17.3 | 14.0 | 13.6 | 14.8 | 29.2 | 29.8 | 23.4 | 17.7 | 21.5 | 18.0 | 8.0 | 9.0 | 17.0 | 21.0 | 20.2 | 15.9 | 25.0 |
| Zeolite A | — | — | 11.4 | 11.6 | 9.4 | 9.1 | 9.9 | | | | 4.6 | — | 4.0 | 12.0 | 9.0 | — | — | — | 7.6 | — |
| Sodium Carboxymethyl Cellulose | 0.1 | 0.2 | 0.14 | 0.15 | 1.6 | 1.5 | 1.7 | | | 1.0 | — | — | — | — | — | — | 0.9 | 0.9 | — | — |
| Optical Brightening Agent | 0.14 | 0.14 | 0.14 | 0.14 | 0.15 | 0.15 | 0.16 | | | 0.15 | 0.14 | 0.15 | 0.15 | 0.15 | 0.15 | 0.14 | 0.14 | 0.14 | 0.13 | 0.15 |
| Oleic Acid | | | — | — | 8.5 | 8.3 | 9.1 | 6.8 | 6.1 | | | | | | | | | | | |
| Sodium hydroxide | | | — | — | 0.91 | 0.88 | 0.97 | 0.7 | 0.65 | | | | | | | | | | | |
| Sodium Xylene Sulphonate | | | — | — | 0.5 | 0.5 | 0.5 | | | | | | | | | | | | | |
| Sodium $C_{12-18}$ Alkyl 3 mole ethoxy sulphate | | | — | 2.0 | — | — | — | | | 2.6 | 2.8 | 3.0 | 3.0 | 3.0 | 2.7 | 1.9 | 0.6 | — | — | 4.0 |
| Mixed Mono and di $C_{16-18}$ alkyl phosphate | | | 0.47 | 0.48 | 1.6 | 1.5 | 1.7 | | | | — | — | — | — | — | — | — | — | 0.4 | — |
| Nonionic Foam Inhibitor | | | 0.95 | 1.0 | — | — | — | | | | | | | | | | | | | |
| $C_{12-18}$ Alcohol 8 mole ethoxylate | | | — | — | 3.0 | 2.9 | 3.1 | | | | 1.9 | — | — | — | — | — | — | — | — | — |
| Sodium Chloride | | | | | | | | 1.7 | 2.0 | | 0.9 | — | — | — | — | — | — | — | — | — |
| Sodium $C_{11-14}$ linear alkyl benzene sulphonate | | | | | | | | | | 7.8 | | | | | | | | | | |

-continued

| | | | | | | | | | | | |
|---|---|---|---|---|---|---|---|---|---|---|---|
| perfume, dye water, | q.v. | | | | | | | | | | |
| Coconut Monoethanolamide | | — | — | — | — | — | — | 2.3 | 3.7 | 3.4 | — |
| Sodium tallow methyl ester sulphonate | | — | — | — | — | — | — | — | — | 3.4 | — |
| Sodium Silicate ($SiO_2$:$Na_2O$, 1.6:1) | | 2.3 | 5.0 | 5.0 | 5.0 | 4.5 | 2.8 | 5.6 | — | — | — |
| Silicone Defoamer | | 0.46 | — | 1.0 | — | — | — | 0.9 | 0.9 | — | 1.0 |

The drawings illustrate variations in Conductivity, Yield Point and Viscosity with variations in Electrolyte concentration and in Active Ingredient.

FIG. 1 is a graph showing conductivity of an aqueous 20.6% solution of Active Ingredients consisting of 2 parts by weight sodium dodecyl benzene sulphonate and 1 part sodium $C_{12-18}$ alkyl 3 mole ethoxy sulphate, with various concentrations of added sodium silicate of $Na_2O:SiO_2$ mole ratio 1:1.6. The figures on the horizontal axis refer to the amount of silicate in the composition expressed as weight percent of solids.

Between 0 and 7%, added silicate solution produces a substantially clear, optically isotropic composition typical of Stage I as described hereinbefore. Between the points marked "A" and "B", Stage II compositions are obtained, which are turbid, unstable and comprise non-Space Filling Flocs of Spherulites. Between "B" and "C", Stage III compositions are obtained, according to the invention. These are turbid, Stable compositions containing substantially Space Filling Flocs of Spherulites, exhibiting a Yield Point and showing only a single liquid phase on High G Centrifuging. Beyond "C", Stage IV compositions are obtained, containing non-Space Filling Flocs of Spherical G Phase, which are non-Stable. It will be seen that the Stable Stage III compositions are obtained in the Conductivity trough around the First Conductivity Minimum.

The left-hand axis indicates Viscosity at 136 $sec^{-1}$ in Pascal Seconds, the figures in parenthesis referring to Conductivity in milliSiemens $cm^{-1}$; the right-hand scale refers to Yield Point in dynes $cm^{-2}$; the horizontal axis represents the total percentage of sodium carbonate present expressed as Dry Weight of sodium carbonate based on the total weight of the composition In the case of sodium carbonate, no minimum is observed in the Conductivity curve (dotted line). This is because the solubility limit of sodium carbonate has been reached, so that further additions of carbonate go into suspension and do not increase the dissolved Electrolyte concentration. No Stage IV can therefore be observed. The sharp rise in Yield Point (right-hand peak), coincides with the onset of Stage III at point "B". This is typical of compositions of our invention.

Figure 1:
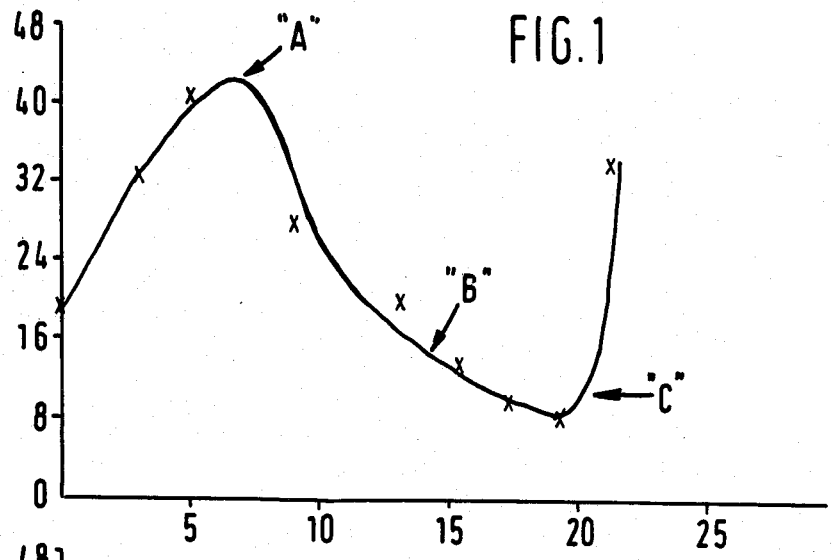
Figure 2:
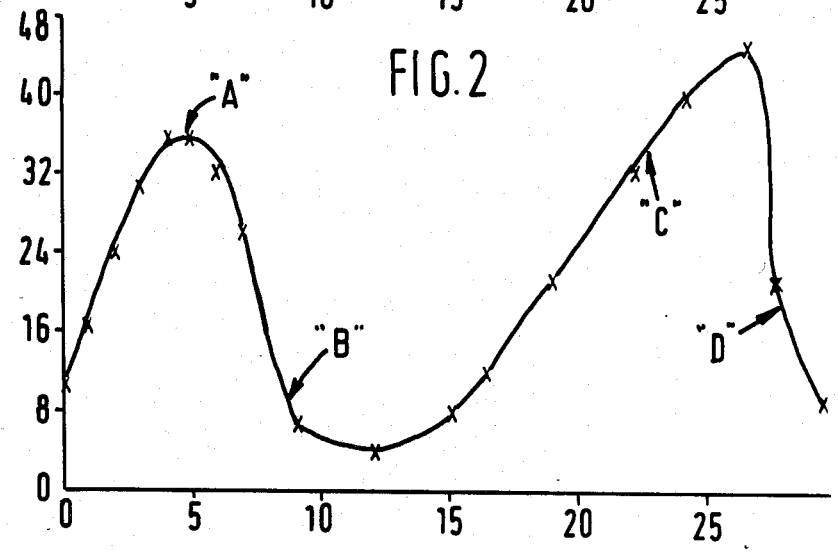
FIG. 2 shows the effect of adding sodium nitrate to the same aqueous Active system. Beyond the point "C" in Stage IV a second Conductivity Maximum is passed, followed by a Second Conductivity Minimum, corresponding to the formation of a Lamellar composition according to Stage V at approximately "D".
Figure 3:
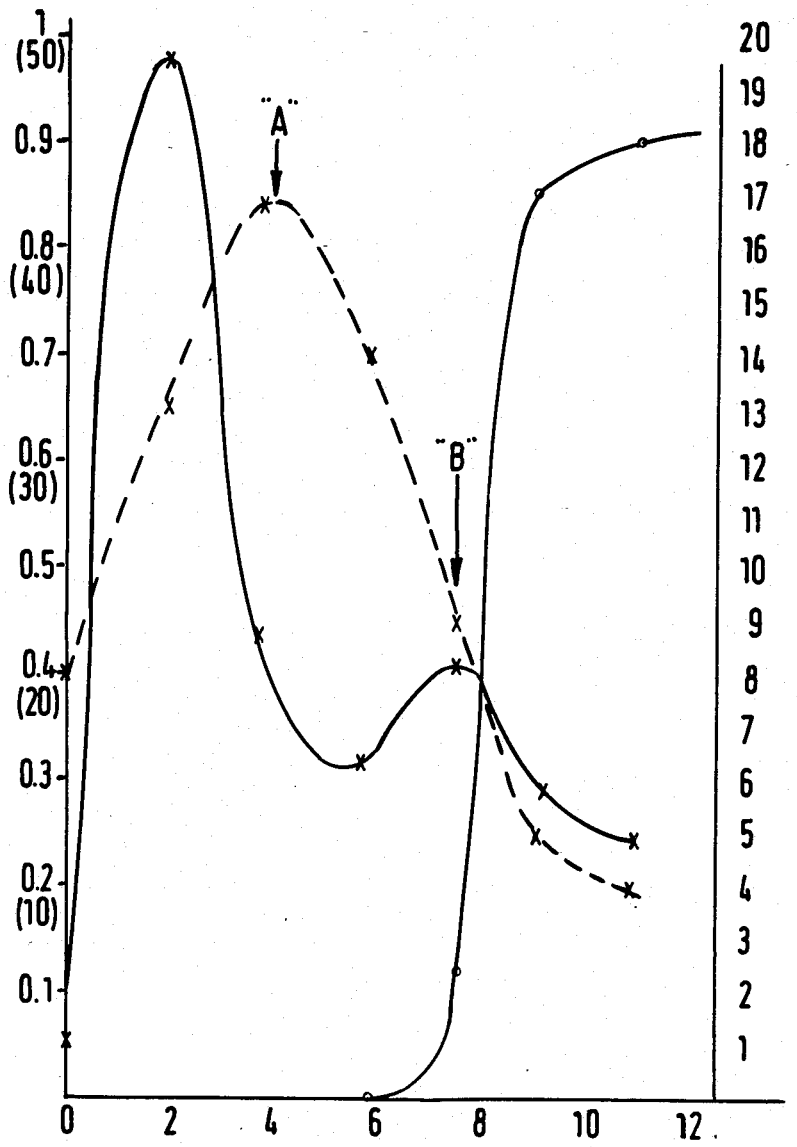
FIG. 3 shows variations in Viscosity, Conductivity and Yield Point when sodium carbonate is added to the same Active system.
Figure 4:
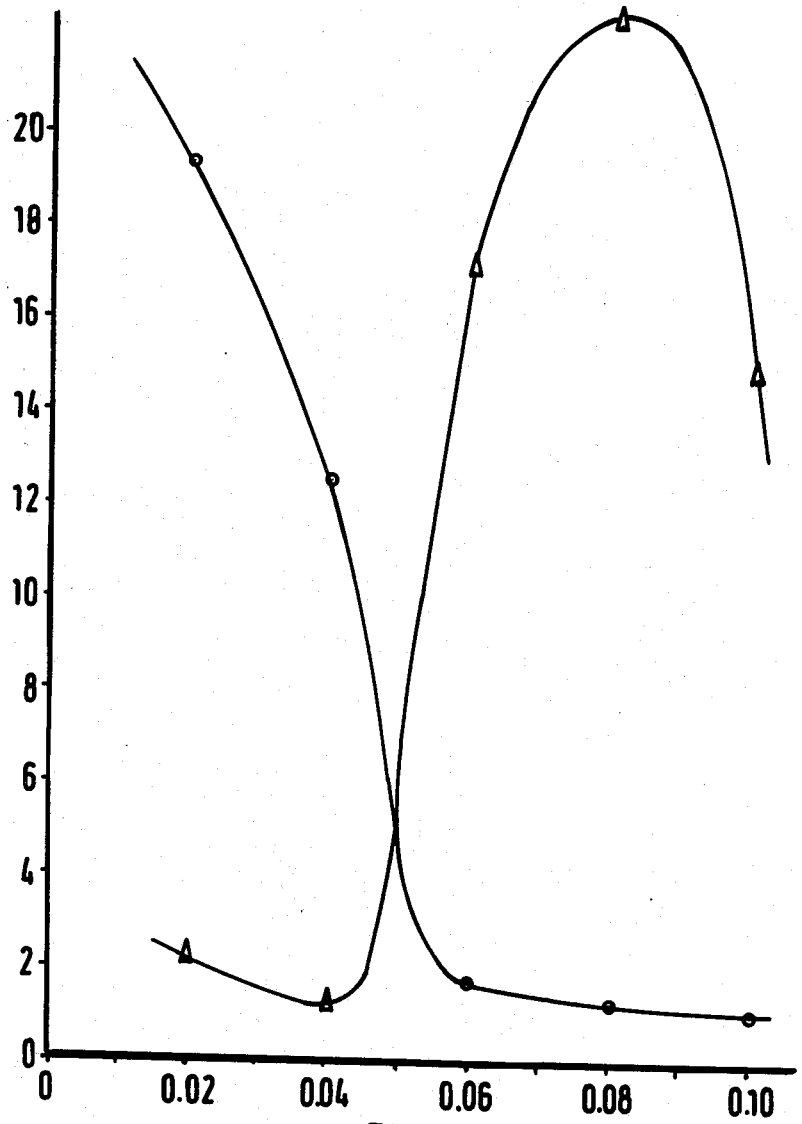

FIG. 4, illustrates the effect of varying the relative proportions of sodium dodecyl benzene sulphonate and coconut monoethanolamide in a composition containing sodium dodecyl benzene sulphonate, sodium tripolyphosphate, sodium carbonate and water in a ratio of 0.2:0.5:0.1:1.0. The horizontal scale represents the Wt. ratio of coconut monoethanolamide to sodium dodecyl benzene sulphonate. The vertical scale represents Conductivity in mS $cm^{-1}$ (circles) and also Viscosity in Pascal Seconds $\times 10$ (triangles).

Figure 5:
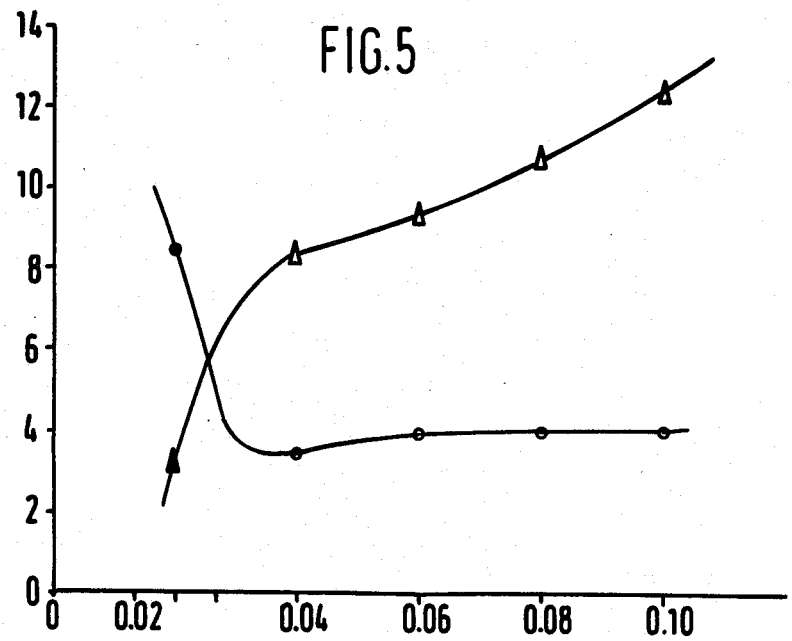

FIG. 5 shows a similar relationship wherein the coconut monoethanolamide is replaced with sodium $C_{12-18}$ alkyl 3 mole ethoxy sulphate. The horizontal scale is the weight ratio of the ether sulphate to the alkyl benzene sulphonate.

FIGS. 4 and 5 illustrate how it is possible to prepare compositions of the invention by modifying the Active Ingredients.

Figure 6:
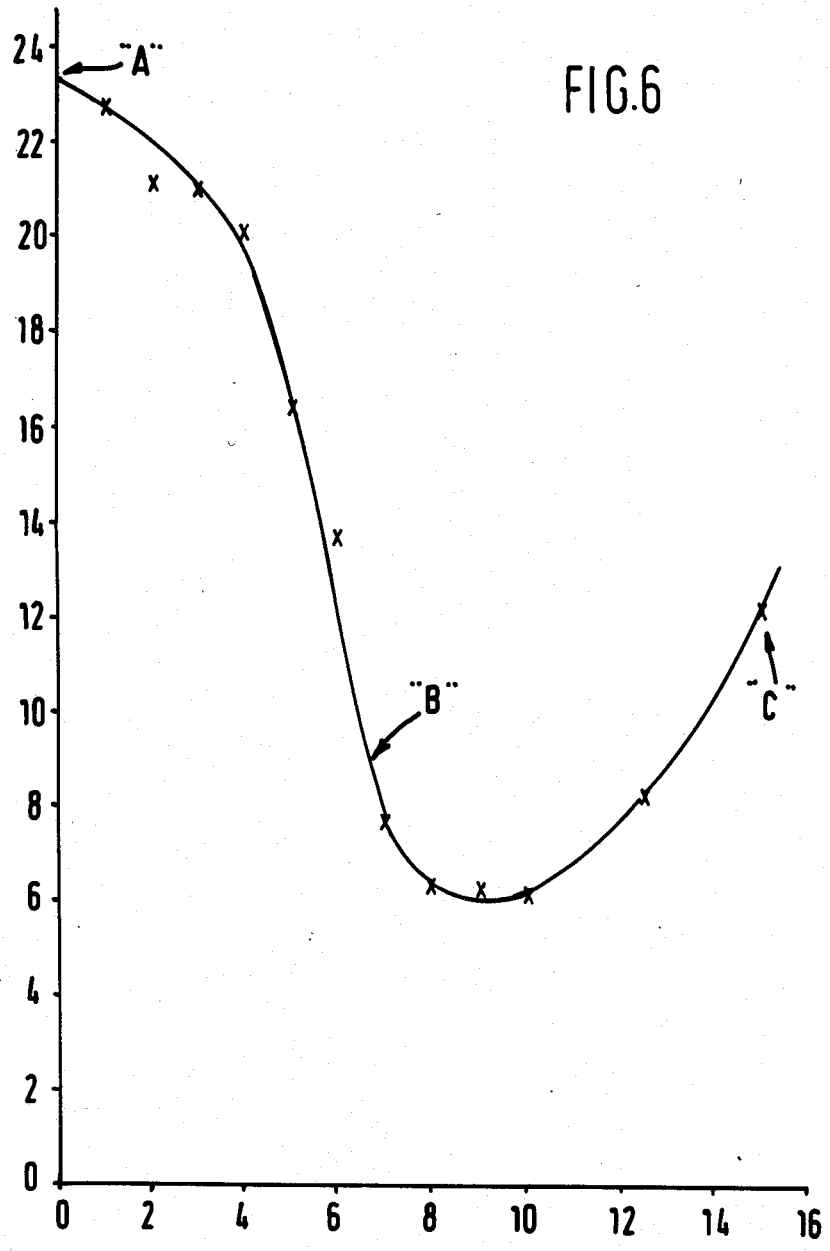

FIG. 6 shows the variation in Conductivity in mS $cm^{-1}$ when sodium nitrate is added in various proportions to a detergent composition containing suspended Builder and having the formulation:

| | Wt % |
|---|---|
| Sodium dodecyl benzene sulphonate | 9 |
| Sodium $C_{12-18}$ alkyl 3 mole ethoxy sulphate | 4 |
| Silicone defoamer | 1 |
| Perfume | 0.6 |
| $C_{16-18}$ mixed mono and di alkyl phosphate | 0.5 |
| Optical Brightener | 0.15 |
| Sodium Tripolyphosphate | 19 |
| Zeolite A | 12 |

Because of the dissolved tripolyphosphate already present Stage I is not observed in this curve. The Conductivity falls from a maximum at "A" until the commencement of Stage III at "B".

Figure 7:
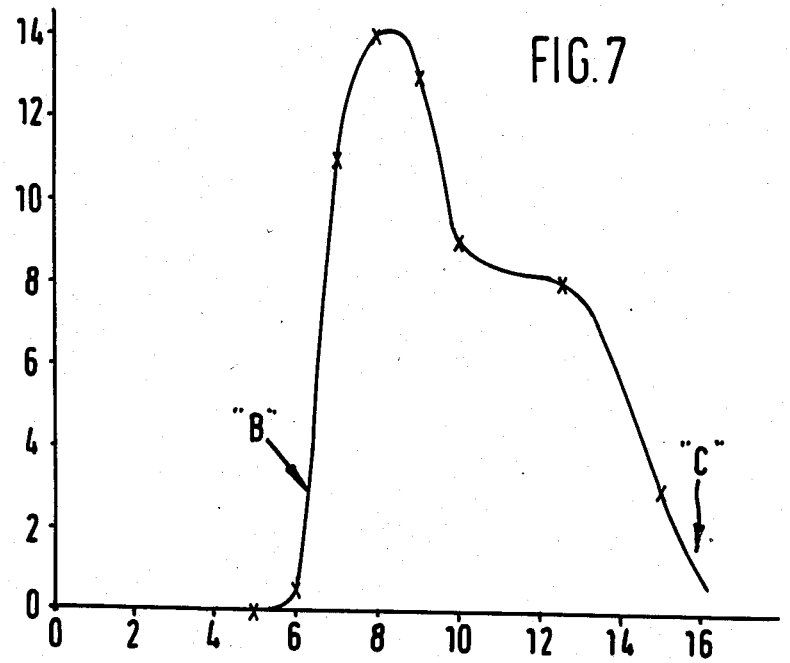
Figure 8:
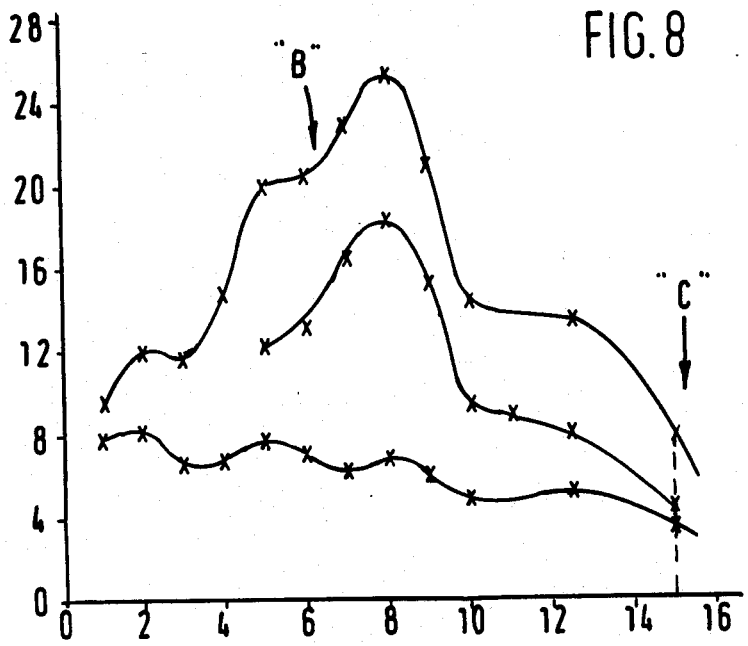

FIG. 7 shows the Yield Point for the same system, in dynes $cm^{-2}$ and FIG. 8 shows the Viscosity at 136 $cm^{-1}$ (lower curve), 21 $cm^{-1}$ (upper curve) and the Viscosity drop (middle curve) in Pascal Seconds $\times 10$.

Figure 9:
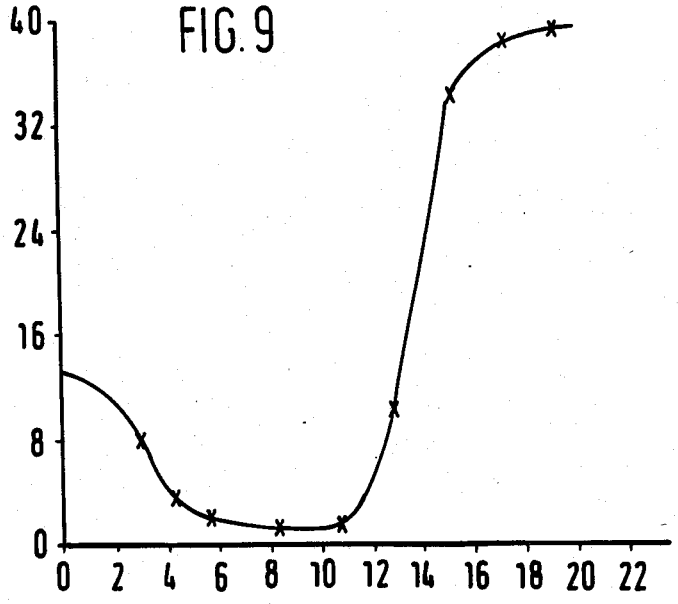

FIG. 9 illustrates the change in Conductivity with varying proportions of sodium silicate in a 20.6% by wt. aqueous solution of sodium dodecyl benzene sulphonate in admixture with coconut monoethanolamide in a weight ratio of 10:4.

Again no Stage I is observed this time because the Active Ingredients are not fully soluble in water at room temperature. The composition is thus turbid and unstable in the absence of Electrolyte.

Figure 10:
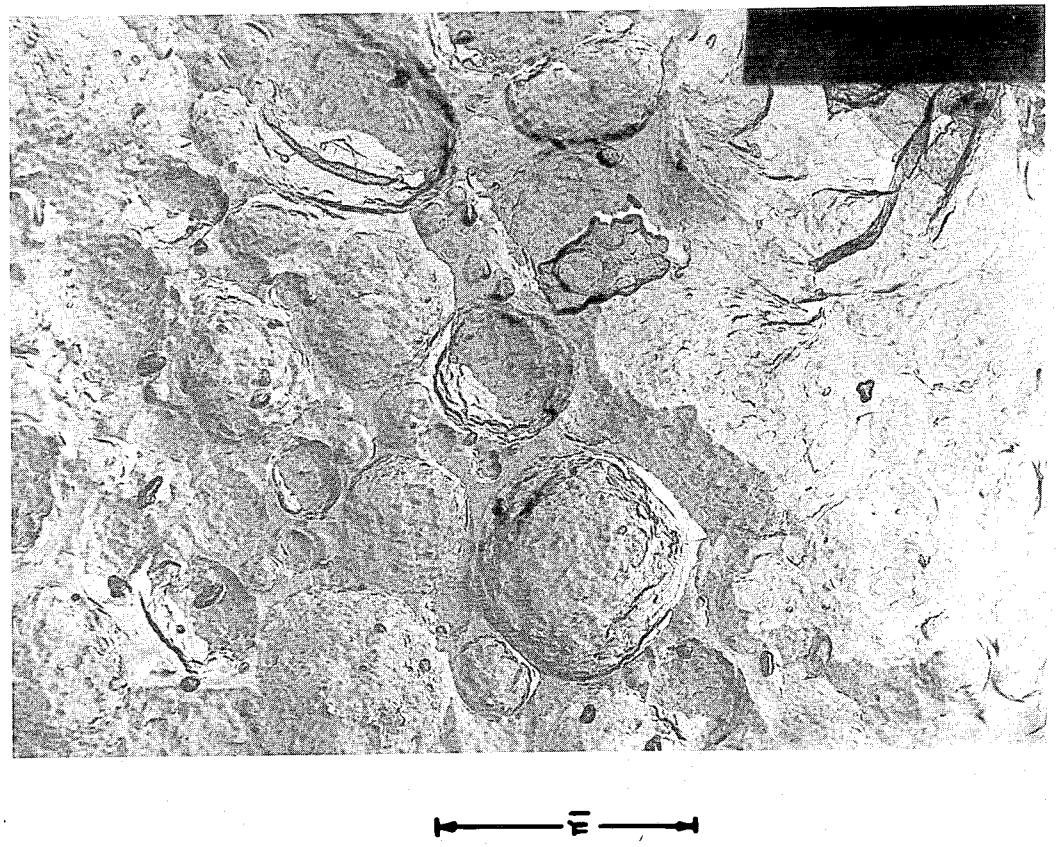
Figure 11:
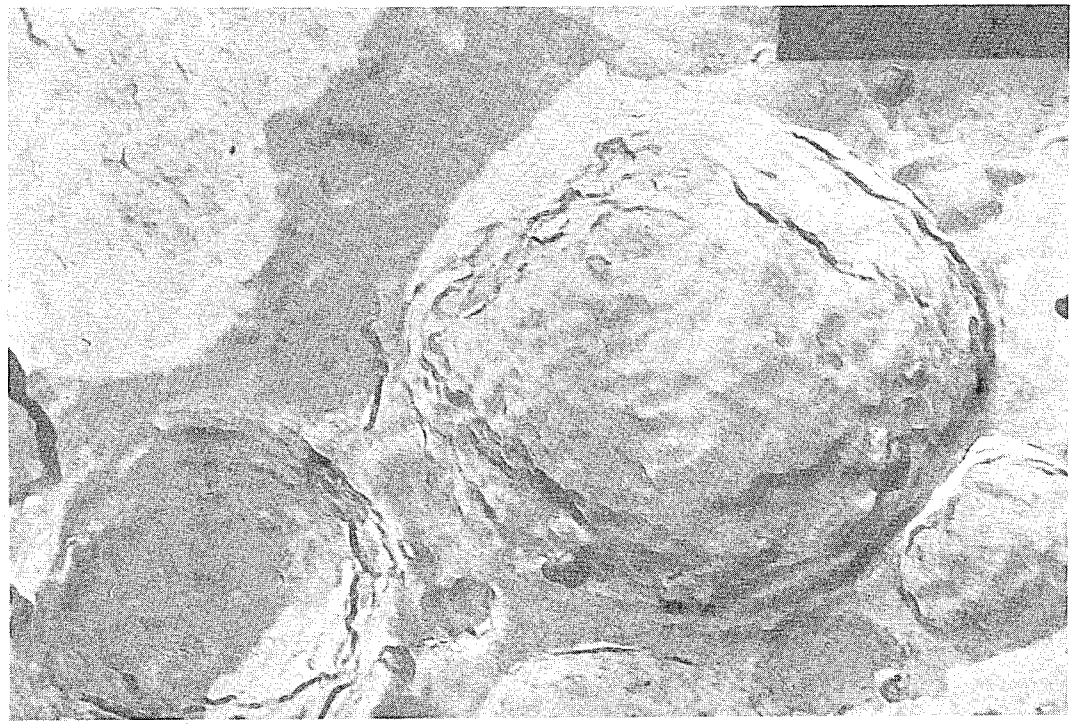

FIGS. 10 and 11 are transmission micrographs of Pt/C replicas, after freeze fracturing, at magnifications of X45,000 and 110,000 (lin) respectively.

The micrographs which were prepared on the Lancaster University transmission electron microscope both represent a sample having the composition:

| | wt. % |
|---|---|
| Sodium dodecyl benzene sulphonate | 11.8 |
| Sodium $C_{12-18}$ alkyl 3 mole ethoxy sulphate | 5.2 |
| Sodium Silicate ($Na_2O:SiO_2$ 1.6:1) | 17.4 |
| Water | balance |

The micrograph shows Spherulites of between 0.2 and 1 micron diameter, which show evidence of being Multiple Vesicles with a concentric structure, having a repeat spacing (including the thickness of one surfactant shell and one adjacent aqueous layer) of 80±Å.

We claim:

1. A Stable, Pourable, fluid, detergent composition comprising water, surfactant and a water soluble, surfactant-desolubilising salt having a weight ratio of surfactant to water such that, when said salt is progressively dissolved in an aqueous micellar solution of said surfactant having said weight ratio, the electrical conductivity of said solution passes through a trough containing a First Conductivity Minimum at which the mixture is Stable and turbid, and said salt being dissolved in the composition in an amount corresponding to said trough, said amount being between the minimum and maximum such amounts at which the composition is Stable and Pourable at a temperature below 5° C. and at 40° C.

2. A composition according to claim 1 wherein said amount of said salt is between the minimum and maximum such amounts at which the composition is stable at 0° C.

3. A composition according to claim 1 wherein said amount of said salt is between the maximum and minimum such amounts at which the composition has a Viscosity Drop greater than 0.4 Pascal seconds.

4. A composition according to claim 3 wherein the Viscosity Drop is between 0.4 and 2 Pascal seconds.

5. A composition according to claim 1 wherein said amount of said salt is between the minimum and maximum such amounts at which no clear aqueous layer separates when the composition is centrifuged for 5 minutes at 20,000G.

6. A composition according to claim 5 wherein said amount of said salt is between the maximum and minimum concentration at which no clear aqueous layer separates when the composition is centrifuged at 20,000G for 90 minutes.

7. A composition according to claim 1 wherein the said amount of said salt is sufficient to render the composition Stable after exposure to high shear.

8. A composition according to claim 1 wherein said amount of said salt is above the maximum at which the composition is Shear-Sensitive.

9. A composition according to claim 1 wherein said amount of said salt is sufficient to render the composition Temperature Stable.

10. A composition according to claim 1 containing from 5 to 30% by weight of surfactant based on the weight of the composition.

11. A composition according to claim 1 wherein said salt consists essentially of at least one alkali metal or ammonium salt selected from carbonates, silicates, tripolyphosphates, orthophosphates, pyrophosphates, nitrilotriacetates, citrates, chloride and nitrate.

12. A composition according to claim 1 containing at least 5%, by weight of the composition, of surfactant selected from substantially linear alkyl benzene sulphonates and mixtures thereof with at least one surfactant selected from anionic, nonionic, cationic, zwitterionic and amphoteric surfactants.

13. A composition comprising an aqueous composition according to claim 1 having, suspended therein, a particulate solid.

14. A composition according to claim 13 wherein said particulate solid comprises a particulate Builder.

15. A composition according to claim 13 wherein said particulate solid comprises an inert abrasive.

16. A composition according to claim 1 wherein said salt comprises a water-soluble Builder, said Builder being present in a total amount in excess of its solubility at ambient temperature in the composition, and said composition comprises solid particles of said Builder suspended therein.

17. A composition according to claim 16 having a Pay Load of from 25 to 75% by weight.

18. A composition according to claim 16 having a Viscosity Drop from 0.45 to 2 Pascal Seconds.

19. A composition according to claim 18 having a Pay Load of at least 35% by weight.

20. A composition according to claim 16 having a weight ratio of Builder to surfactant of greater than 1.2:1.

21. A composition according to claim 20 having a weight ratio of Builder to surfactant of 1.5:1 to 3.5:1.

22. A composition according to claim 16 containing from 10 to 13.5% of surfactant based on the weight of the composition.

23. A composition according to claim 16 wherein the surfactant comprises a mixture of (A) a non-alkoxylated sulphated or sulphonated anionic surfactant with (B) an alkoxylated anionic surfactant and/or a non-ionic surfactant.

24. A composition according to claim 23 wherein the component (A) comprises an alkyl benzene sulphonate having from 8 to 22 aliphatic carbon atoms.

25. A composition according to claim 24 wherein component (A) comprises an alkenyl sulphonate, alkane sulphonate, alkylphenol sulphate, sulphocarboxylic acid and/or sulphocarboxylic ester, having from 8 t 22 carbon atoms in the alkyl or alkenyl group.

26. A composition according to claim 16 containing a foam booster.

27. A composition according to claim 16 containing a foam inhibitor.

28. A composition according to claim 27 wherein the foam inhibitor comprises an organopolysiloxane foam inhibitor.

29. A composition according to claim 16 containing suspended particles of sodium tripolyphosphate and/or zeolite.

30. A composition according to claim 16 which contains encapsulated bleaches and/or enzymes in suspension.

* * * * *